US005765076A

United States Patent [19]

Ogata et al.

[11] Patent Number: 5,765,076

[45] Date of Patent: Jun. 9, 1998

[54] METHOD AND APPARATUS FOR FORMING AN ELECTROSTATIC LATENT IMAGE WITH TONER RECOVERY

[75] Inventors: Syuichiro Ogata; Yoshitatsu Okiyama; Kazuyoshi Yoshida; Toru Ishihara; Kuniharu Hayashi; Hiroyuki Yajima; Mikio Yamamoto; Takashi Itaya; Masanori Maekawa; Kazuhiko Nagaoka, all of Tokyo, Japan

[73] Assignee: Oki Data Corporation, Tokyo, Japan

[21] Appl. No.: 792,910

[22] Filed: Oct. 1, 1996

Related U.S. Application Data

[63] Continuation of Ser. No. 651,462, May 23, 1996, abandoned.

[30] Foreign Application Priority Data

May 26, 1995 [JP] Japan ..... 7-128354
Feb. 29, 1996 [JP] Japan ..... 8-042509

[51] Int. Cl.[6] ..... G03G 15/00

[52] U.S. Cl. ..... 397/168; 399/100; 399/149

[58] Field of Search ..... 399/98, 99, 100, 399/128, 129, 149, 50, 107, 115

[56] References Cited

U.S. PATENT DOCUMENTS 4,924,268 5/1990 Ogura ..... 399/99
5,321,471 6/1994 Ito et al. ..... 399/129
5,371,578 12/1994 Asano et al. ..... 399/100
5,404,198 4/1995 Noda et al. ..... 399/107

*Primary Examiner*—Arthur T. Grimley
*Assistant Examiner*—Quana Grainger
*Attorney, Agent, or Firm*—Panitech Schwarze Jacobs & Nadel, P.C.

[57] ABSTRACT

A method of forming an electrostatic latent image includes printing operation and toner recovering operation. the printing operation includes charging, forming an electrostatic latent image, developing, and transferring operations. The toner recovering operation includes the step of charging the photosensitive drum in timed relation to the rotation of the photosensitive drum after printing operation so that reversely charged toner deposited on the charging roller migrates from the charging roller to the photosensitive drum. The toner migrated from the charging roller to the photosensitive drum is recovered into a developer. An apparatus for forming an image includes a charging roller, photosensitive drum, developing roller, and transfer roller. The apparatus further includes a reversely-charged-toner recovering device which causes the photosensitive drum to be charged in timed relation to the rotation of the photosensitive drum after printing operation so that the reversely charged toner deposited on the charging roller migrates to the photosensitive drum. The developer recovers the toner which has migrated to the photosensitive drum from the charging roller.

24 Claims, 20 Drawing Sheets

FIG.11A

| | | | | | | | | | | | | |
|---|---|---|---|---|---|---|---|---|---|---|---|---|
| $V_{CH2}$ (KV) | -3.3 | -3 | -2.6 | -2.3 | -2 | -1.6 | -1.3 | -1 | -0.5 | 0 | 0.4 | 0.8 |
| $V_{CH1}$ (KV) | -2 | -2 | -2 | -2 | -2 | -2 | -2 | -2 | -2 | -2 | -2 | -2 |
| $\lvert V_{CH2}\rvert <> \lvert V_{CH1}\rvert$ | > | > | > | > | = | < | < | < | < | < | < | < |
| $V_o$ (KV) | -2.8 | -2.5 | -2.1 | -1.8 | -1.5 | -1.1 | -0.8 | -0.5 | 0 | 0 | 0 | 0.3 |
| $V_p$ (KV) | -2.5 | -2.5 | -2.1 | -1.8 | -1.5 | -1.5 | -1.5 | -1.5 | -1.5 | -1.5 | -1.5 | -1.5 |
| $V_o - V_p$ (KV) | -0.3 | 0 | 0 | 0 | 0 | 0.4 | 0.7 | 1 | 1.5 | 1.5 | 1.5 | 1.8 |
| $\lvert V_{CH1} - V_o\rvert <> \lvert V_i\rvert$ | > | = | < | < | = | > | > | > | > | > | > | > |
| Mt ($g/m^2$) | 0 | 0 | 0 | 0 | 0 | 0.75 | 2.1 | 2.7 | 3.3 | 3.75 | 17 | 17 |
| TONER POLARITY | + | - | - | - | - | - | - | - | - | - | - | - |
| REGION | I | II | | | | III | | | | | IV | |

FIG.11B

| | | | | | | | | | | | | |
|---|---|---|---|---|---|---|---|---|---|---|---|---|
| $V_{CH2}$ (KV) | -3.3 | -3 | -2.6 | -2.3 | -2 | -1.6 | -1.3 | -1 | -0.5 | 0 | 0.4 | 0.8 |
| $V_{CH1}$ (KV) | -1.3 | -1.3 | -1.3 | -1.3 | -1.3 | -1.3 | -1.3 | -1.3 | -1.3 | -1.3 | -1.3 | -1.3 |
| $\lvert V_{CH2}\rvert <> \lvert V_{CH1}\rvert$ | > | > | > | > | > | > | = | < | < | < | < | < |
| $V_o$ (KV) | -2.8 | -2.5 | -2.1 | -1.8 | -1.5 | -1.1 | -0.8 | -0.5 | 0 | 0 | 0 | 0.3 |
| $V_p$ (KV) | -1.8 | -1.8 | -1.8 | -1.8 | -1.5 | -1.1 | -0.8 | -0.8 | -0.8 | -0.8 | -0.8 | -0.8 |
| $V_o - V_p$ (KV) | -1 | -0.7 | -0.3 | 0 | 0 | 0 | 0 | 0.3 | 0.8 | 0.8 | 0.8 | 1.1 |
| $\lvert V_{CH1} - V_o\rvert <> \lvert V_i\rvert$ | > | > | > | = | < | < | = | > | > | > | > | > |
| Mt ($g/m^2$) | 0 | 0 | 0 | 0 | 0 | 0 | 0 | 1.65 | 2.4 | 3 | 15 | 19 |
| TONER POLARITY | + | + | + | - | - | - | - | - | - | - | - | - |
| REGION | I | | | II | | | | III | | | IV | |

FIG.11C

| | | | | | | | | | | | | |
|---|---|---|---|---|---|---|---|---|---|---|---|---|
| $V_{CH2}$ (KV) | -3.3 | -3 | -2.6 | -2.3 | -2 | -1.6 | -1.3 | -1 | -0.5 | 0 | 0.4 | 0.8 |
| $V_{CH1}$ (KV) | -1 | -1 | -1 | -1 | -1 | -1 | -1 | -1 | -1 | -1 | -1 | -1 |
| $\lvert V_{CH2}\rvert <> \lvert V_{CH1}\rvert$ | > | > | > | > | > | > | > | = | < | < | < | < |
| $V_o$ (KV) | -2.8 | -2.5 | -2.1 | -1.8 | -1.5 | -1.1 | -0.8 | -0.5 | 0 | 0 | 0 | 0.3 |
| $V_p$ (KV) | -1.5 | -1.5 | -1.5 | -1.5 | -1.5 | -1.1 | -0.8 | -0.5 | -0.5 | -0.5 | -0.5 | -0.5 |
| $V_o - V_p$ (KV) | -1.3 | -1 | -0.6 | -0.3 | 0 | 0 | 0 | 0 | 0.5 | 0.5 | 0.5 | 0.8 |
| $\lvert V_{CH1} - V_o\rvert <> \lvert V_i\rvert$ | > | > | > | > | = | < | < | = | > | > | > | > |
| Mt ($g/m^2$) | 0 | 0 | 0 | 0 | 0 | 0 | 0 | 0 | 1.95 | 2.25 | 16 | 18 |
| TONER POLARITY | + | + | + | + | - | - | - | - | - | - | - | - |
| REGION | I | | | | II | | | | III | | IV | |

| RANGE | NUMBER OF PRINTED PAGES | NUMBER OF PRINTED PAGES BEFORE TONER RECOVERY OPERATION |
|---|---|---|
| 1 | $0 \sim A_1$ | $N_1$ |
| 2 | $(A_1+1) \sim A_2$ | $N_2$ |
| 3 | $(A_2+1) \sim A_3$ | $N_3$ |
| ⋮ | ⋮ | ⋮ |
| ⋮ | ⋮ | ⋮ |
| ⋮ | ⋮ | ⋮ |
| n | $(A_{n+1}+1) \sim A_n$ | $N_n$ |

| NUMBER OF PRINTED PAGES FOR NEW, UNUSED TONER | PERIOD DURING WHICH CHARGING ROLLER IS 0V | ROTATION OF CHARGING ROLLER |
|---|---|---|
| 0 ~ 3000 | $T_3$ | 1 |
| 3001 ~ 4000 | $2 \times T_3$ | 2 |
| 4001 ~ 5000 | $3 \times T_3$ | 3 |

METHOD AND APPARATUS FOR FORMING AN ELECTROSTATIC LATENT IMAGE WITH TONER RECOVERY

This is a continuation of application Ser. No. 08/651,462, filed May 23, 1996, now abandoned.

BACKGROUND OF THE INVENTION

The present invention relates to a method of forming an image and an image-forming apparatus for use in the method.

With conventional image-forming apparatuses for use with, for example, an electrophotography recording apparatus, a latent image is formed on the surface of a photosensitive drum uniformly charged by a charging roller. A toner developer supplies toner to the latent image to form a toner image and the toner image is then transferred to the print paper by a transfer roller.

If the toner is made from a single non-magnetic composition, it is desirable that toner particles in the toner developer are all charged to the same polarity. However, some particles are charged to the opposite polarity to that of most of particles. For example, positively charged particles (referred to as reversely charged toner hereinafter) are among the negatively charged toner particles (referred to as developer toner) which are used for developing a latent image. Reverse charged toner particles are considered to result due to the fact that some toner particles receive positive charges from the transfer roller when a toner layer is formed on the developing roller in the toner developer and when the toner image is transferred onto the print paper.

After the surface of the photosensitive drum is uniformly charged and subsequently a latent image is formed on the charged surface, developer toner is deposited on the surface to form a toner image. Reversely charged toner is deposited on the background area on which a latent image is not formed. The toner image is transferred with the aid of Coulomb force to the print paper positively charged by the transfer roller. However, the reversely charged toner is not transferred to the print paper and remains deposited on the photosensitive drum. The reversely charged toner is then delivered by the photosensitive drum to the charging roller where the reversely charged toner builds up on the charging roller to which a high negative voltage is applied.

With the aforementioned prior art image-forming apparatus, the deposition of reversely charged toner on the charging roller results in increased electrical resistance of the charging roller, decreasing the surface potential of the photosensitive drum. Decreased surface potential of the photosensitive drum causes the developer toner to cling to the background of the latent image formed on the photosensitive drum, leading to soiling of the surface of the photosensitive drum. This adversely affects the print quality.

SUMMARY OF THE INVENTION

An object of the present invention is to provide a method of forming an image and an image-forming apparatus therefor in which a latent image is formed without a decrease in the surface potential of the photosensitive drum, thereby maintaining good print quality.

A method of forming an electrostatic latent image includes printing operation and toner recovering operation. The printing operation includes charging, forming an electrostatic latent image, developing, and transferring operations. The toner recovering operation includes the step of charging the photosensitive drum in timed relation to the rotation of the photosensitive drum after printing operation so that reversely charged toner deposited on the charging roller migrates from the charging roller to the photosensitive drum. The toner migrated from the charging roller to the photosensitive drum is recovered into a developer. The photosensitive drum is charged during the toner recovering operation by changing the polarities and voltage values of the charging roller and auxiliary charging roller. An apparatus for forming an image includes a charging roller, photosensitive drum, developing roller, and transfer roller. The apparatus further includes a reversely-charged-toner recovering device which causes the photosensitive drum to be charged in timed relation to the rotation of the photosensitive drum after printing operation so that the reversely charged toner deposited on the charging roller migrates to the photosensitive drum. The developer recovers the toner which has migrated to the photosensitive drum from the charging roller. The values and polarities of the voltages applied to the charging roller and auxiliary charging roller are changed in timed relation to the rotation of the photosensitive drum so as to invert the polarity of reversely charged toner particles.

BRIEF DESCRIPTION OF THE DRAWINGS

FIGS. 11A–11C illustrate the polarities of the surface potential of the photosensitive drum and the toner deposited on the photosensitive drum.

DETAILED DESCRIPTION OF THE INVENTION

Preferred embodiments will now be described with reference to the accompanying drawings. Like elements have been given like numerals and references throughout the drawings.

First Embodiment

Figure 1:
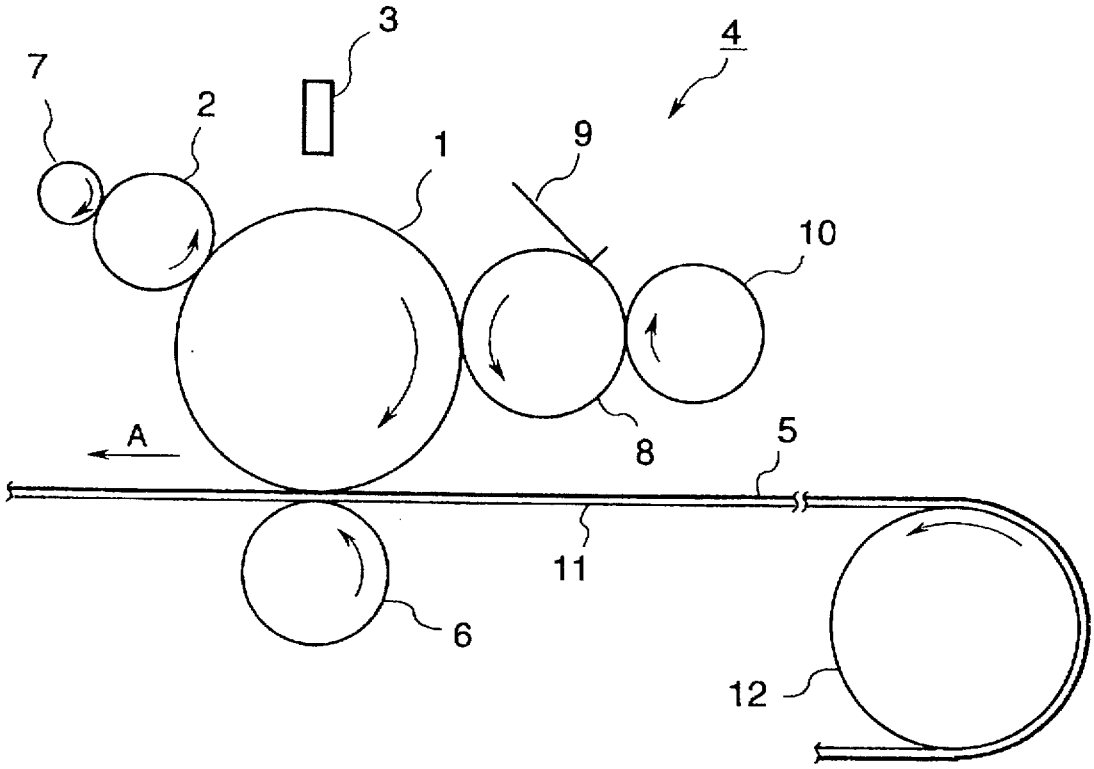
FIG. 1 illustrates a general construction of an image-forming apparatus according to a first embodiment.

FIG. 1 illustrates a general construction of an image-forming apparatus according to a first embodiment. Referring to FIG. 1, the apparatus includes a charging roller 2 for uniformly charging the surface of the photosensitive drum 1, recording head 3 for forming an electrostatic latent image on the surface of the uniformly charged photosensitive drum 1, toner developer 4 for depositing developer toner onto the electrostatic latent image to form a toner image thereon, and transfer roller 6 for transferring the toner image onto a print medium or print paper 5.

The photosensitive drum 1 is in the form of, for example, an aluminum base on which a negative charge type organic photoconductive material is applied.

An auxiliary charging roller 7 is in contact with or in proximity to charging roller 2. The charging roller 2 and auxiliary charging roller 7 are formed of a semiconductive rubber. The toner developer 4 includes a developing roller 8, developing blade 9, and sponge roller 10. Toner is delivered from a toner storage, not shown, via the sponge roller 10 to the developing blade 9, and is converted into a thin layer on the surface of the developing roller 8. The thin layer of toner then contacts the surface of the photosensitive drum. The toner is negatively charged by triboelectrification when the toner passes between the highly negatively charged developing roller 8 and sponge roller 10 and is pressed against the surface of the developing roller 8 by the developing blade 9 into a thin layer. The developing roller 8 is formed of a semiconductive rubber material.

The photosensitive drum 1, charging roller 2, auxiliary roller 7, and developing roller 8, and sponge roller 10 are rotatably supported on a frame, not shown, and are rotated in the directions shown by arrows by a later described motor via a drive transmission mechanism such as a gear train.

The recording head 3 includes a circuit board and a selfoc lens array. Mounted on the circuit board are an LED array, not shown, and a drive IC for driving the LED array. The LED array is so oriented that the light emitting elements thereof are aligned in a plane parallel to the axis of the photosensitive drum 1. The selfoc lens array, not shown, is used to focus the light emitted from the LED array on the surface of the photosensitive drum 1. The recording head 3 causes the LED array to emit light in accordance with an image signal, so that the emitted light illuminates the surface of the photosensitive drum 1, which is uniformly negatively charged by the charging roller 2, to form an electrostatic latent image on the photosensitive drum 1.

The photosensitive drum 1 and transfer roller 6 are in contact with a carrier belt 11 which transports the recording paper 5. The carrier belt 11 is in the form of a looped semiconductive plastic film and is disposed around a drive roller 12, not shown, and a driven roller, not shown. The carrier belt 11 is rotated by a later described motor to transport the recording paper 5 in the direction shown by arrow A.

Figure 2:
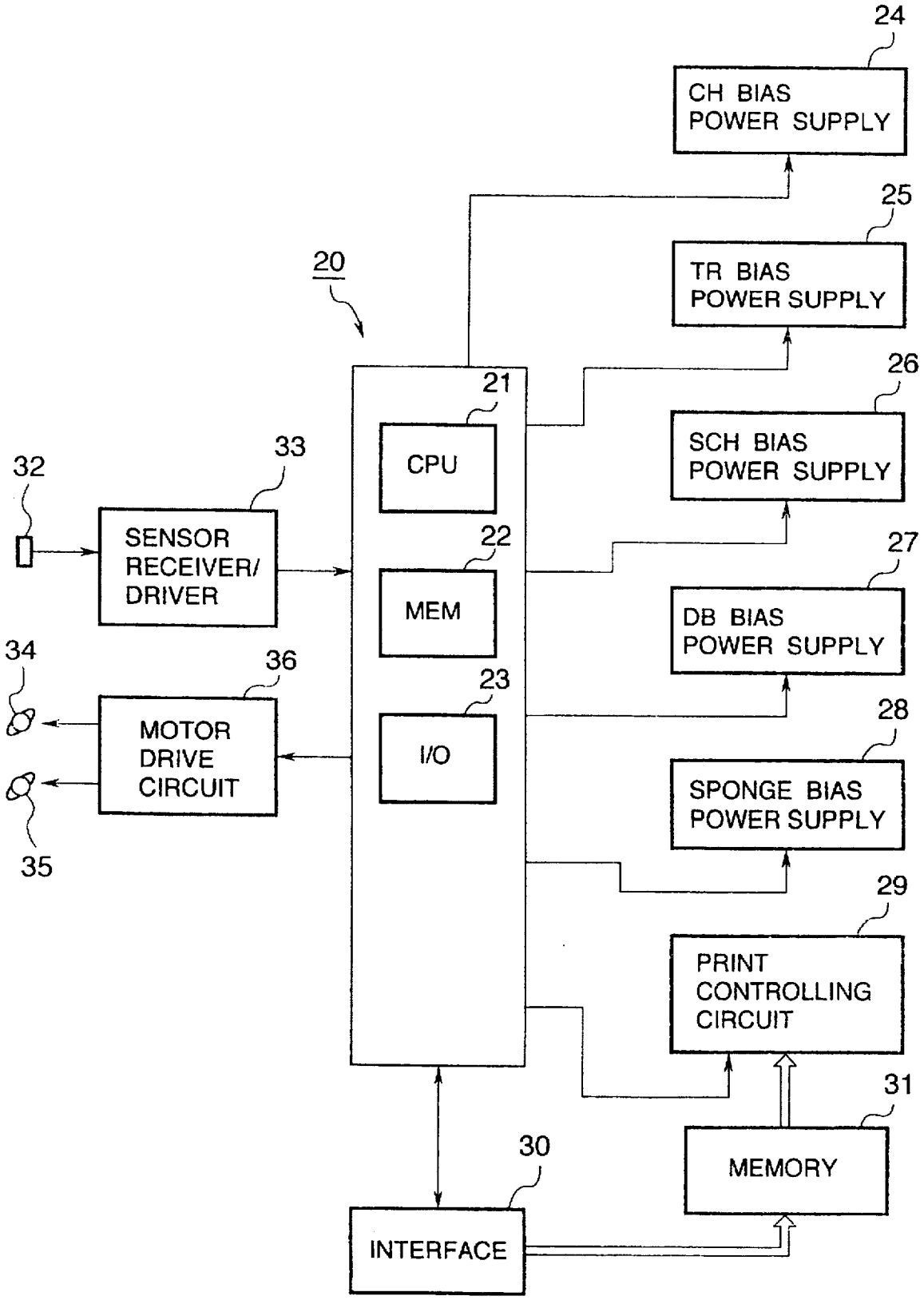
FIG. 2 is a block diagram showing a controlling circuit according to the first embodiment.

FIG. 2 is a block diagram showing a controlling circuit according to the first embodiment. The controller 20 takes the form of a microcomputer which includes a central processing unit (referred to as CPU hereinafter) 21, main memory (referred to as MEM) 22, and input/output port (referred to as I/O) 23. The CPU 21 controls the entire operation of the apparatus in accordance with the control program stored in the MEM 22. The CPU 21 controls via the I/O 23 a CH bias power supply 24 for supply power to the charging roller 2, TR bias power supply 25 for supplying power to the transfer roller 6, SCH bias power supply 26 for supplying power to the auxiliary charging roller 7, DB bias power supply 27 for supplying power to the developing roller 8, and SP bias power supply 28 for supplying power to the sponge roller 10.

The CPU 21 turns on and off the CH bias power supply, TR bias power supply 25, SCH bias power supply 26, DB bias power supply 27, and SP bias power supply 28 in accordance with the control program.

The CPU 21 is also connected to a print-controlling circuit 29 and interface 30 via the I/O 23. The print-controlling circuit 29 receives a command from the CPU 21, in accordance with which the print-controlling circuit 29 controls a period of time for which the recording head 3 illuminates the surface of the photosensitive drum 1, thereby forming an electrostatic latent image on the surface of the photosensitive drum 1. The interface 30 directs the image data supplied from, for example, a host computer to a memory 31. The CPU 21 is also connected via a sensor receiver/driver 33 to a paper sensor 32 in the form of photosensor. The paper sensor 32 detects the leading edge of the print paper 5.

The CPU 21 is also connected via the I/O 23 to a motor drive circuit 36 which controllably drives motors 34 and 35 to rotate. The motor 34 causes a paper-feeding roller, not shown, to rotate. The paper-feeding roller feeds the print paper 5 from a paper cassette, not shown, to the carrier belt 11. The motor 35 drives the photosensitive drum 1, charging roller 2, auxiliary charging roller 7, developing roller 8, sponge roller 10, and drive roller 12 in the respective directions shown by arrows as shown in FIG. 1. FIGS. 3, 4, and 5 illustrate the migration of reversely charged toner particles during image-forming operation. FIG. 6 is a timing chart illustrating the image-forming operation in the first embodiment. Referring to FIG. 6, signals A–J indicate operations or outputs of the motor 34, motor 35, paper sensor 32, CH bias power supply 24, SCH bias power supply 26, recording head 3, DB bias power supply 27, SP bias power supply 28, TR bias power supply 25, and photosensitive drum 1, respectively. The time duration T1 represents "printing operation" and the time duration T2 represents "toner recovery operation."

The operation of the first embodiment will now be described with reference to FIG. 6. When a start button, not shown, is pressed at time t1, the CPU 21 sends a drive signal to the motor drive circuit 36. In response to the drive signal, the motor drive circuit 36 causes the motor 34 to rotate so that the print paper 5 is fed to the carrier belt 11 from the paper cassette. The leading edge of the paper 5 is detected by the paper sensor 32.

When the leading edge of the print paper 5 is detected at time t2, the CPU 21 causes via the motor drive circuit 36 the motor 35 to rotate so that the photosensitive drum 1, charging roller 2, transfer roller 6, auxiliary roller 7, developing roller 8, sponge roller 10, and carrier belt 11 are rotated in the directions shown by arrows in FIG. 1. At the same time, the CPU 21 turns on the CH bias power supply 24, SCH bias power supply 26, DB bias power supply 27, SP bias power supply 28. Table 1 shows the voltages applied to the respective rollers when printing and when recovering toner.

TABLE 1

| | When printing | When recovering toner |
|---|---|---|
| Charging roller | −1350 V | −300 V |
| Auxiliary charging roller | −950 V | −950 V |
| Developing roller | −300 V | +400 V |
| Sponge roller | −450 V | 0 V |
| Transfer roller | +1500 V | +1500 V |

During the printing operation, the charging roller 2, auxiliary charging roller 7, developing roller 8, and sponge roller 10 receive a voltage of −1350 V, −950 V, −300 V, and −450 V, respectively, as shown in Table 1. The charging roller 2 supplies negative charges to the photosensitive drum 1, so that the surface of the photosensitive drum 1 is uniformly charged to −800 V.

Figure 3A:
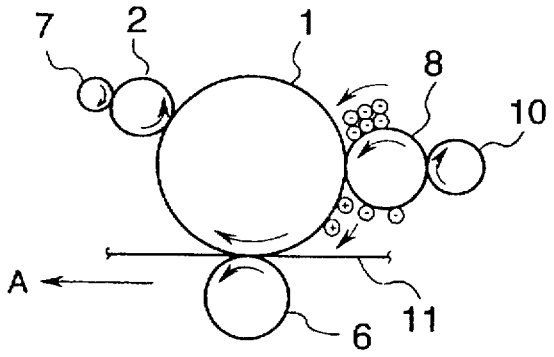
FIGS. 3A–3H illustrate the migration of reversely charged toner particles during image-forming operation.
Figure 3B:
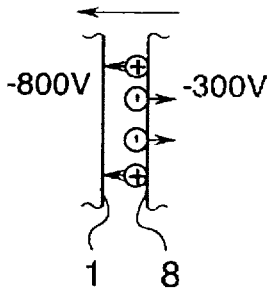

The toner in the toner developer 4 is strongly rubbed by the developing roller 8 and the developing blade 9 so that most of the toner particles are negatively charged by triboelectrification but some of the toner particles become reversely charged, that is positively charged. When the background part of the electrostatic latent image, i.e., unilluminated area of the surface of the photosensitive drum 1 charged to −800 V arrives at the toner developer 4, an electric field is developed in the direction from the developing roller 8 to the photosensitive drum 1. Therefore, the reversely charged toner particles migrate with the aid of Coulomb force along the electric field to the photosensitive drum 1, and are deposited thereon as shown in FIGS. 3A and 3B.

At time t3, the CPU 21 causes the memory 31 to output image data to the print controlling circuit 29. The CPU 21 then drives via the print controlling circuit 29 the light emitting elements of the recording head 3 to form an electrostatic latent image on the surface of the photosensitive drum 1. The electrostatic latent image has a potential close to zero volts due to photo energy acquired from light emitted by the recording head 3. When the electrostatic latent image arrives at the developer 4, the developer toner particles are deposited on the electrostatic latent image to form a toner image while at the same time reversely charged toner particles are deposited on the background, i.e., unilluminated areas of the surface of the photosensitive drum 1. At time t4, the CPU 21 turns on the TR bias power supply 25 to apply a voltage of +1500 V to the transfer roller 6 so as to positively charge the print paper 5.

Figure 3C:
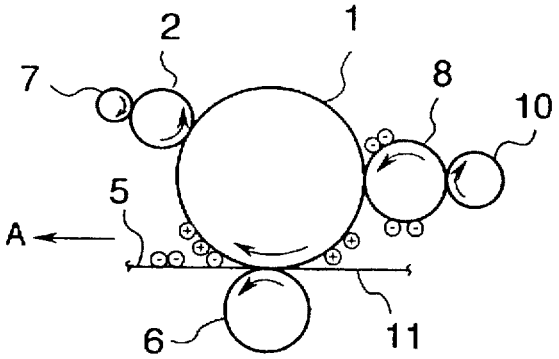
Figure 3D:
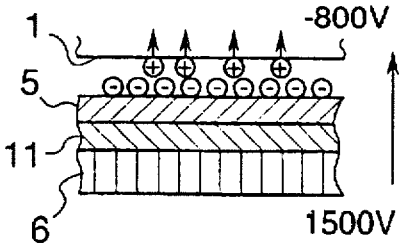
Figure 3E:
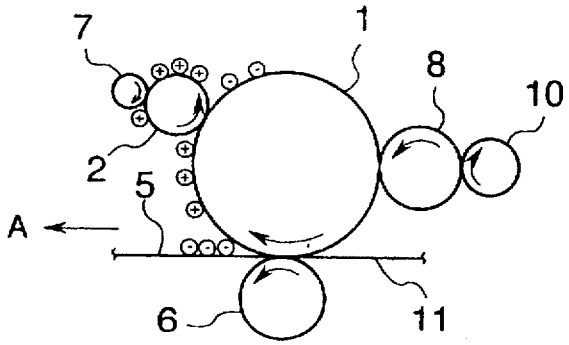
Figure 3F:
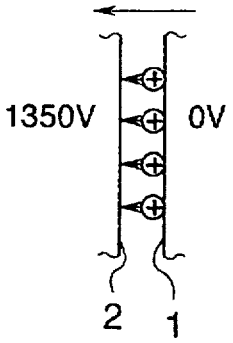
Figure 3G:
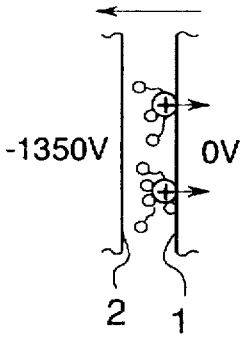

When the background area of the photosensitive drum 1 which has been charged to −800 V arrives at the transfer roller 6, an electric field is developed in the direction from the transfer roller 6 to the photosensitive drum 1 as shown in FIG. 3D so that the developer toner deposited on the electrostatic latent image is transferred to the print paper 5 as shown in FIG. 3C along the electric field to the print paper 5 with the aid of Coulomb force while the reversely charged toner particles remain deposited on the photosensitive drum 1. Potential difference increases when the background area of the photosensitive drum 1 charged to −800 V moves closer to and away from the print paper 5, causing discharge between the photosensitive drum 1 and the print paper 5 so that the potential of the background decreases to nearly zero volts. The print paper 5 is transported in the direction shown by arrow A. When the "background area" having a potential decreased to nearly zero volts reaches the charging roller 2 to which a voltage of −1350 V is applied, an electric field is developed in the direction from the photosensitive drum 1 to the charging roller 2 as shown in FIG. 3F. Therefore, the reversely charged toner particles deposited on the background area migrate along the electric field with the aid of Coulomb force toward the charging roller 2 as shown in FIG. 3E. The potential difference between the photosensitive drum 1 and charging roller 2 increases as the surface of the photosensitive drum 1 moves closer to and away from the charging roller 2, causing discharge therebetween. During the discharge, some of the reversely charged toner particles acquire electrons as shown in FIG. 3G so that the polarity of charge of the toner particles are inverted from positive to negative. Thus, the toner particles inverted from positive to negative do not cling to the charging roller 2 but remain deposited on the photosensitive drum 1 and are delivered to the toner developer 4 where the toner particles are recycled as developer toner together with the fresh toner in the toner developer 4.

Figure 3H:
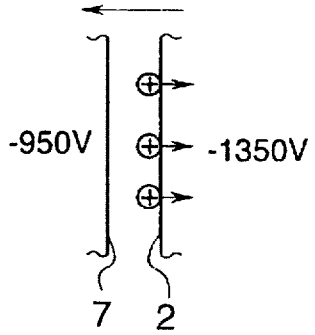

The auxiliary charging roller 7 is charged to a voltage of about −950 V and the charging roller 2 is charged to a voltage of −1350 V. Therefore, an electric field is developed in the direction from the auxiliary charging roller 7 to the charging roller 2 as shown in FIG. 3H, so that the reversely charged toner particles do not cling to the auxiliary charging roller 7 but are attracted to the charging roller2.

At time t5, the CPU 21 turns off the recording head 3 to complete formation of the electrostatic latent image, and shifts from "printing operation" to "toner recovering operation" by causing the CH bias power supply 24 to switch at t6, and the DB bias power supply 27 and SP bias power supply 28 to switch at t7. The charging roller 2 now receives a voltage of −300 V, and the developing roller 8 and sponge roller 10 receive voltages of +400 V and zero volts, respectively, as shown in "When recovering toner" of Table 1.

Figure 4A:
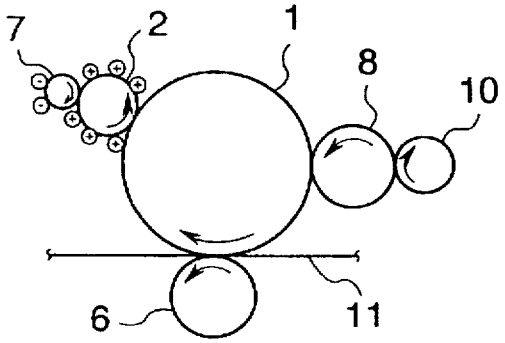
FIGS. 4A–4D illustrate the migration of reversely charged toner particles during image-forming operation.
Figure 4B:
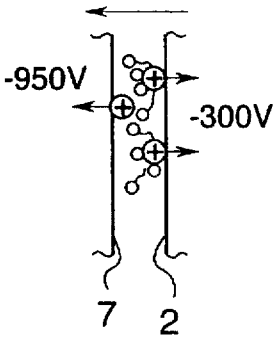

Since the auxiliary charging roller 7 has been charged to a voltage of −950 V, the electric field across the auxiliary charging roller 7 and the charging roller 2 is inverted from the direction before time t6, and the potential difference between the rollers 7 and 2 is now higher than the firing potential, i.e., 550 V, causing discharge in the vicinity of the contact between the rollers 7 and 2. The reversely charged toner particles acquire electrons due to the discharge between the rollers 7 and 2 as shown in FIG. 4B, the polarities of most of the reversely charged toner particles are now inverted from positive to negative, and such toner particles are deposited on the charging roller 2. The rest of the reversely charged toner particles acquire some amount of electrons due to the discharge, or do not acquire electrons at all, and are attracted to the auxiliary charging roller 7 as shown in FIG. 4A.

Figure 4C:
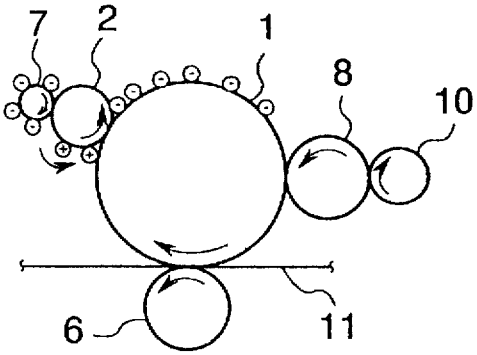
Figure 4D:
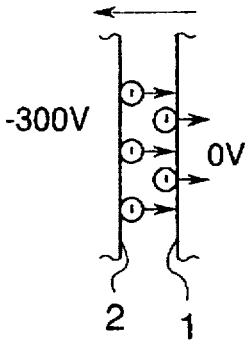

Due to the fact that the charging roller 2 is charged to −300 V and the surface potential of the photosensitive drum 1 is nearly zero volts, an electric field is developed in the direction shown in FIG. 4D. Therefore, the negatively charged toner particles clinging to the charging roller 2 are attracted to the photosensitive drum 1 by Coulomb force as shown in FIG. 4C.

Figure 5A:
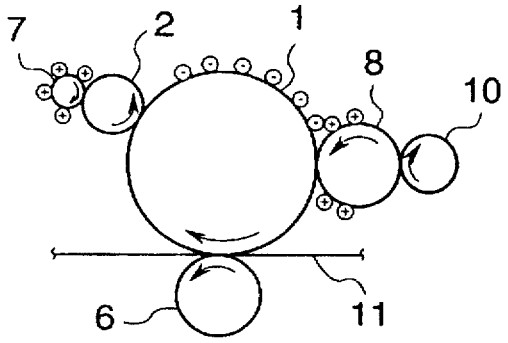
FIGS. 5A–5D illustrate the migration of reversely charged toner particles during toner-recovering operation.
Figure 5B:
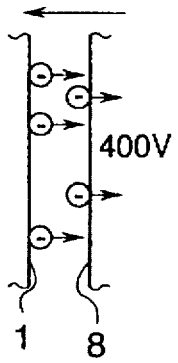
Figure 6:
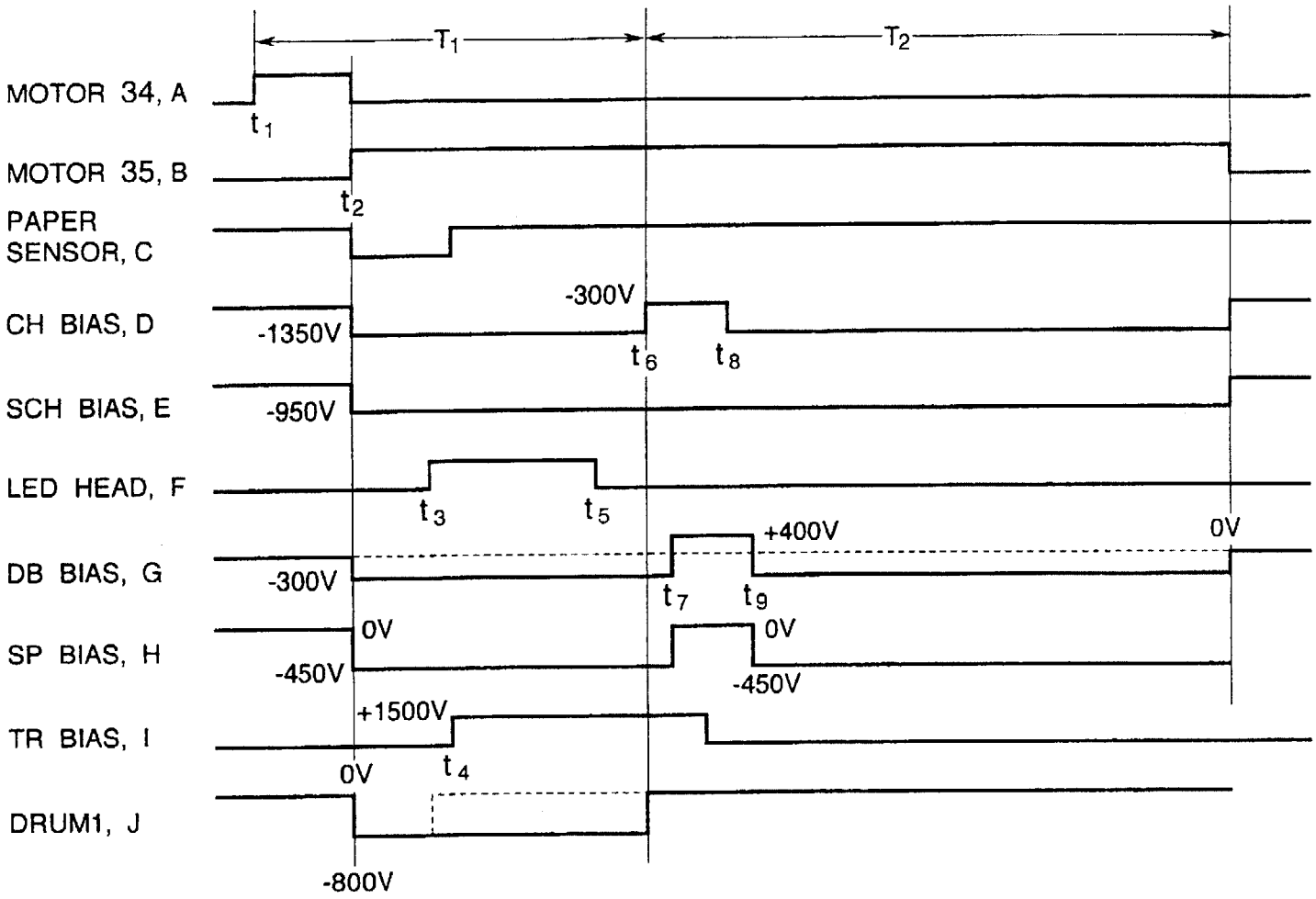
FIG. 6 is a timing chart illustrating the image-forming operation of the first embodiment.

Due to the fact that the developing roller 8 is charged to +400 V for a time period t7–t9 and the surface potential of the photosensitive drum 1 is nearly zero volts, an electric filed is developed in the direction shown in FIG. 5B so that the toner is recovered as developer toner into the toner developer 4 as shown in FIG. 5A.

At time t8, the CPU 21 causes the CH bias power supply 24 to switch so that the charging roller 2 receives a voltage of −1350 V. At time t9, the CPU 21 causes the DB bias power supply 27 and SP bias power supply 28 to switch so that the developing roller 8 and sponge roller 10 receive bias voltages of −300 V and −450 V, respectively.

Figure 5C:
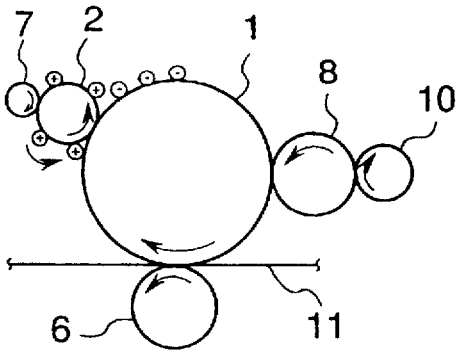
Figure 5D:
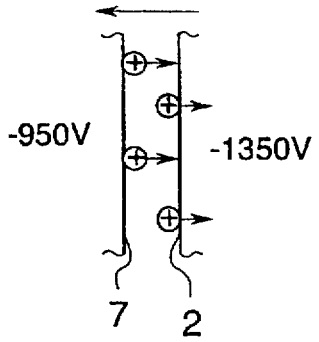

Due to the fact that the charging roller 2 is charged to a bias voltage of −1350 V and the auxiliary roller 7 s charged to a bias voltage of −950 V as shown in FIG. 5C, the electric field across the rollers 7 and 2 is again inverted as shown in FIG. 5D so that the reversely charged toner particles on the auxiliary roller 7 migrate to the charging roller 2. The reversely charged toner particles attracted to the charging roller 2 are then deposited to the photosensitive drum 1, which delivers the toner particles to the developer 4. The developer 4 receives the toner particles from the photosensitive drum 1 and the recovered toner particles are re-used together with fresh toner in the developer.

Through the aforementioned steps, most of the reversely charged toner particles deposited on the charging roller 2 acquire electrons due to discharge occurring between the charging roller 2 and auxiliary charging roller 7 so that the toner particles are negatively charged as a whole and recovered into the toner developer 4. Thus, reversely charged toner particles do not remain deposited on the charging roller 2, being prevented from building up on the charging roller 2.

The bias voltages applied to the respective rollers, shown in Table 1 may be any voltages which meet the following conditions.

When printing:

$$(Vch2-Vch1)<Vd\ (=550V) \quad (1)$$

where Vch1 and Vch2 are bias voltages applied to the charging roller 2 and the auxiliary charging roller 7, respectively, and Vd is a voltage difference that causes discharge between the charging roller 2 and photosensitive drum 1 when the surface of the photosensitive drum moves closer to and away from the charging roller 2.

When recovering toner:

$$(Vch1-Vch2)>Vd\ (=550V) \quad (2)$$

where voltage on roller 8 is greater than the surface potential on the drum 1 (3).

According to the first embodiment, the polarity of reversely charged toner particles deposited on the charging roller 2 are inverted by discharge between the charging roller and the photosensitive drum when the surface of the photosensitive drum moves closer to and away from the charging roller 2, and are then attracted to the photosensitive drum to subsequently recover into the toner developer. The recovered toner is recycled as developer toner. Thus, the first embodiment allows forming of an electrostatic latent image without decreasing the surface potential of the photosensitive drum, maintaining high print quality.

Second Embodiment

The construction of an image-forming apparatus according to a second embodiment is substantially the same as that of the first embodiment except that the auxiliary charging roller 7 is provided in contact with the charging roller 2 so that the difference in circumferential velocity between the rollers 2 and 7 causes triboelectrification, and the following relation is satisfied:

$$|Vch1|\geqq|Vch2|,\ Vch2<0 \quad (4)$$

where Vch1 and Vch2 are bias voltages applied to the charging roller 2 and the auxiliary charging roller 7, respectively.

Figure 7:
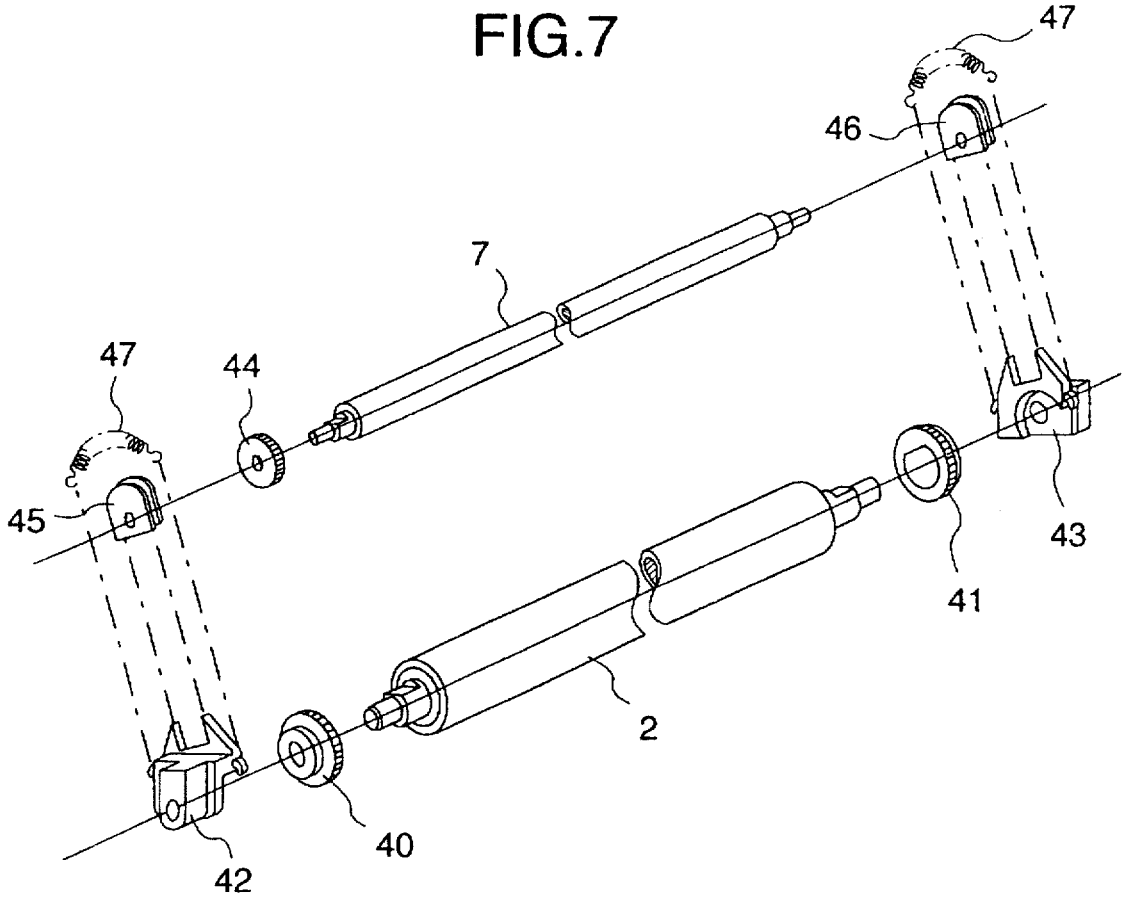
FIG. 7 shows another way of providing a difference in circumferential speed between the two rollers 2 and 7.
Figure 8:
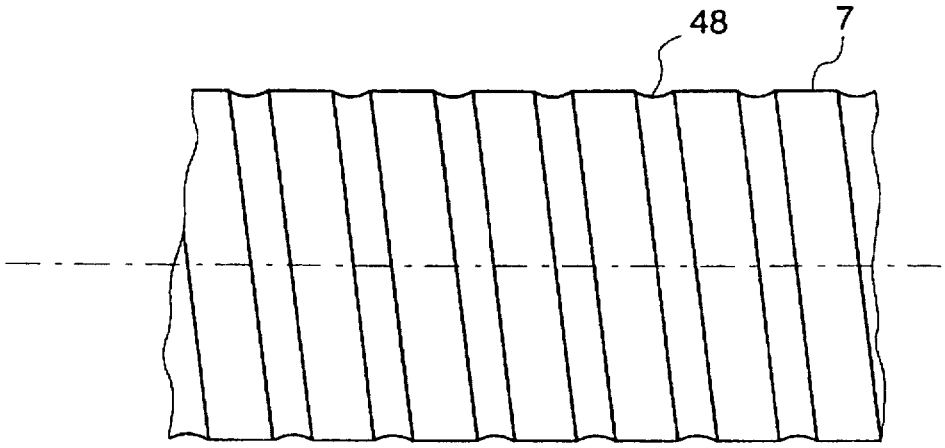
FIG. 8 shows an enlarged essential part of the auxiliary charging roller having a spiral groove.

In order to provide a difference in circumferential speed between the charging roller 2 and the auxiliary charging roller 7, the two rollers 2 and 7 may be rotatably supported in contact with each other and rotated via gears, not shown, mounted to one ends of the rollers 2 and 7 with an additional idler gear interposed between the gears so that the two rollers 2 and 7 rotate in the same direction. FIG. 7 shows another way of providing a difference in circumferential speed between the two rollers 2 and 7. Referring to FIG. 7, the charging roller 2 is provided with gears 40 and 41 at axial ends thereof and rotatably supported by bearings 42 and 43. The auxiliary charging roller 7 is provided with a gear 44 at one axial end thereof having a different gear ratio from the gear 40, and rotatably supported by bearings 45 and 46. The bearings 42 and 45 are urged toward each other by means of a tension spring 47 so that the gear 44 meshes with the gear 40. The bearings 43 and 46 are urged toward each other by means of another tension spring 47. Thus, the two rollers 2 and 7 are assembled into an integral structure with the two rollers 2 and 7 in contact with each other, so that the two rollers 2 and 7 rotate at different circumferential speeds when the roller 2 is rotated via the gear 41. The charging roller 2 is formed of a semiconductive rubber, and the auxiliary roller 7 is in the form of a semiconductive rubber or a metal shaft.

The operation of the the second embodiment will now be described. In the second embodiment, toner recovery operation is performed while performing printing operation. The bias voltage Vch1 applied to the charging roller 2 is −1350 V. The reversely charged toner particles deposited on the charging roller 2 are rubbed by the two rollers 2 and 7 which causes triboelectrification to occur due to the difference in circumferential speed between the two rollers, so that the toner particles acquire charges. The two rollers generate negative charges since they receive negative voltages and therefore the reversely charged toner particles deposited on the charging roller 2 are now negatively charged. The toner particles polarity of which has changed from positive to negative, now migrate to the charging roller 2 if |Vch1|<|Vch2|, and are deposited on the two rollers if |Vch1|=|Vch2|. The surface of the photosensitive drum 1 is charged to −800 V by the charging roller 2 so that an electric field is developed in the direction from the photosensitive drum 1 to the charging roller 2. Therefore, the negatively charged toner particles on the charging roller 2 migrate to the photosensitive drum 1 along the electric field with the aid of Coulomb force, and are delivered to the toner developer 4. An electric field is developed in the direction from the developing roller 8 to the photosensitive drum 1 since the developing roller 8 receives a voltage of −300 V. Thus, the negatively charged toner particles on the photosensitive drum 1 migrate along the electric field with the aid of Coulomb force to the developing roller 8 and are recovered into the toner developer 4 for re-use.

As mentioned above, reversely charged toner is recovered into the toner developer 4 more efficiently with $|Vch1|<|Vch2|$ than with $|Vch1|=|Vch2|$, since the toner particles having polarity thereof inverted from positive to negative migrate to the charging roller 2 if $|Vch1||Vch2|$. According to the second embodiment, the polarity of reversely charged toner particles deposited on the charging roller 2 are inverted by triboelectrification and are then attracted to the photosensitive drum 1 to be subsequently recovered into the toner developer 4. The recovered toner is re-used as developer toner. Thus, the second embodiment allows forming of an electrostatic latent image without decreasing the surface potential of the photosensitive drum, maintaining high print quality.

Third Embodiment

The construction of an image-forming apparatus according to a third embodiment is substantially the same as those of the first and second embodiments except that the auxiliary charging roller 7 has a spiral groove 48 formed in the roller surface , the groove extending longitudinally along the auxiliary roller 7. The spiral groove 48 serves to catch particles of print medium or paper particles. The photosensitive drum 1 attracts paper particles which have acquired positive charges from the transfer roller 6. The paper particles deposited on the photosensitive drum 1 migrate due to Coulomb force to the charging roller 2 and auxiliary roller 7 which are charged to negative voltages, and the paper particles builds up there. The paper particles deposited on the rollers 2 and 7 adversely affect triboelectrification at the contact between the charging roller 2 and the auxiliary roller 7. Especially, paper particles of relatively large sizes are detrimental to triboelectrification.

Paper particles of relatively large sizes are trapped in the groove 48 as the auxiliary roller 7 rotates, and move little by little along the groove 48 toward the end of the groove 48 which does not affect the image-forming operation. The third embodiment is particularly effective when $|Vch1|<|Vch2|$, since the paper particles are attracted to the auxiliary roller 7. The third embodiment allows efficient development of triboelectrification, ensuring inversion of polarity of reversely charged toner particles deposited on the charging roller.

Fourth Embodiment

Figure 9A:
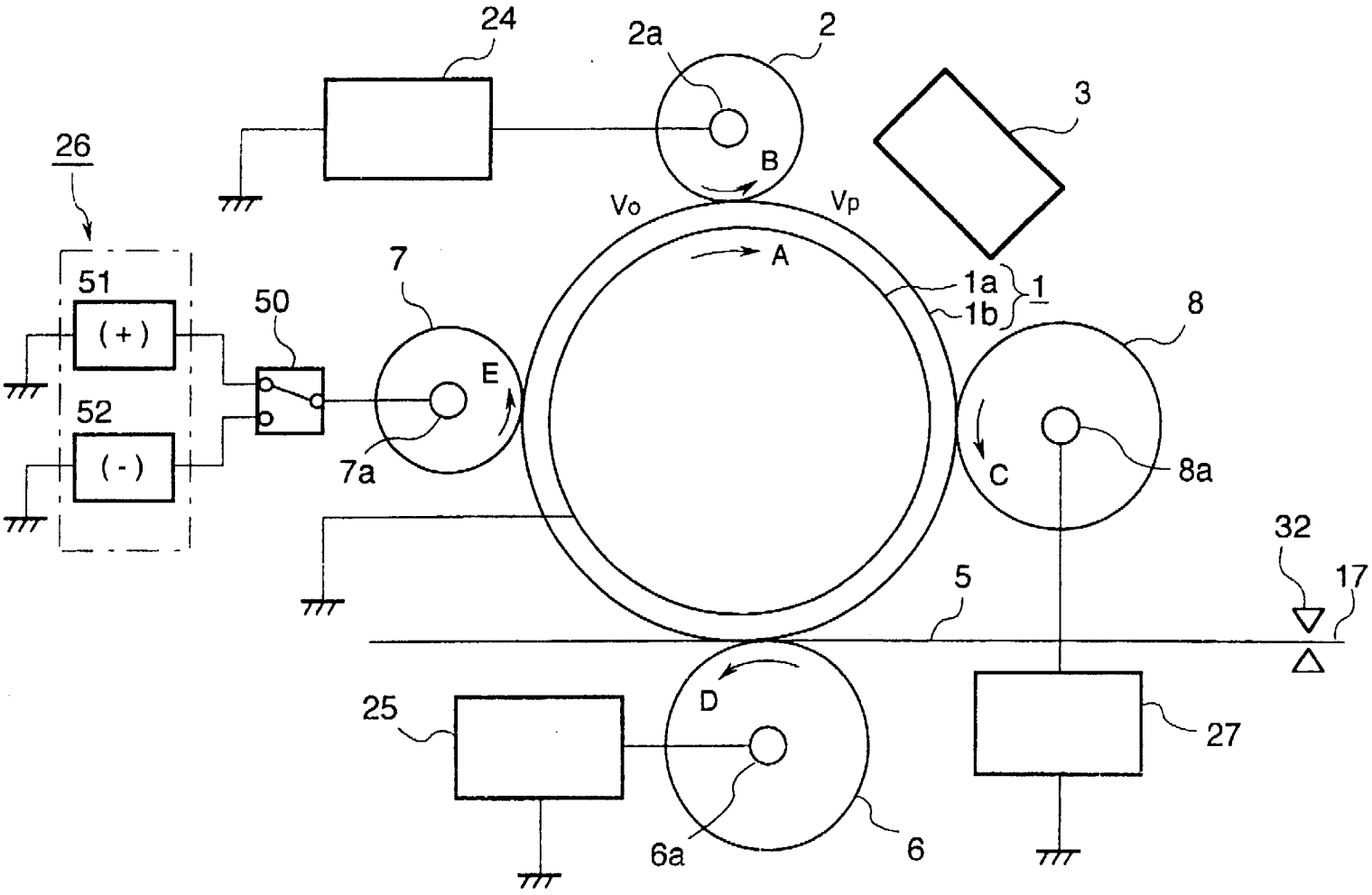
FIG. 9A illustrates a general construction of an image-forming apparatus according to a fourth embodiment.

FIG. 9A illustrates a general construction of an image-forming apparatus according to a fourth embodiment. In the fourth embodiment, the auxiliary charging roller 7 is provided downstream of the transfer roller 6 but upstream of the charging roller 2, and is in contact with the photosensitive drum 1. The bias voltages Vch1 and Vch2 applied to the rollers 2 and 7, respectively, are such that $|Vch1|\leqq|Vch2|$ and $Vch2\leqq 0$, being maintained for a time period from the contact of a later described PTEC position with the auxiliary charging roller 7 till the a later described PLEC position contacts with the charging roller roller 7. The voltages Vch1 and Vch2 are such that surface potential of the drum 1 is maintained substantially the same before and after the drum 1 is charged by the charging roller 2.

The charging roller 2, developing roller 8, transfer roller 6, and auxiliary roller 7 are disposed around the photosensitive drum 1 rotating in the direction shown by arrow A. The rollers 2, 8, 6, and 7 rotate in the directions shown by arrows B, C, D, and E, respectively. A recording head 3 is located between the charging roller 2 and the developing roller 8. The recording head 3 includes light emitting elements such as light emitting diodes that illuminate the surface of the photosensitive drum 1 in accordance with the print data. A paper sensor 32 for detecting the image-forming timing is in a paper path 17. The photosensitive drum 1, charging roller 2, developing roller 8, transfer roller 6, and auxiliary roller 7 are coupled together via a power-transmitting mechanism such as a gear train, not shown, and are rotated by a later described motor. The developing roller 8 is in the toner developer 4 just as in the first embodiment. The sponge roller is also provided together with the developing roller 8, but the description is focused on the developing roller 8.

The photosensitive drum 1 includes a drum base 1*a* which is grounded, and a negative-charge type photoconductive material 1*b* applied to the surface of the drum base 1*a*. The charging roller 2 and developing roller 8 are electrically conductive rubber rollers supported on shafts 2*a* and 8*a*, respectively. The shafts 2*a* and 8*a* are connected to the CH bias power supply 24 and DB bias power supply 27, respectively, which supply negative voltages. The charging roller 2 and developing roller 8 are in pressure contact with the photosensitive drum 1. The transfer roller 6 is an electrically conductive roller supported on a shaft 4*a* connected to the TR bias power supply 25 which supplies a positive voltage. The transfer roller 6 is in pressure contact with the photosensitive drum 1.

The auxiliary charging roller 7 is formed of a foaming material containing conductive carbon therein, and is supported on a shaft 7*a* connected to the SCH bias power supply 26 via a selector switch 50. The auxiliary charging roller 7 is in pressure contact with the photosensitive drum 1. The SCH bias power supply 26 includes a first SCH bias power supply 51 for supplying a positive voltage to the shaft 7*a*, and a second SCH bias power supply 52 for supplying a negative voltage to the shaft 7*a*. The auxiliary charging roller 7 also serves as a cleaning roller which receives a positive voltage during the printing operation so as to recover negatively charged developer toner deposited on the photosensitive drum 1.

Figure 10:
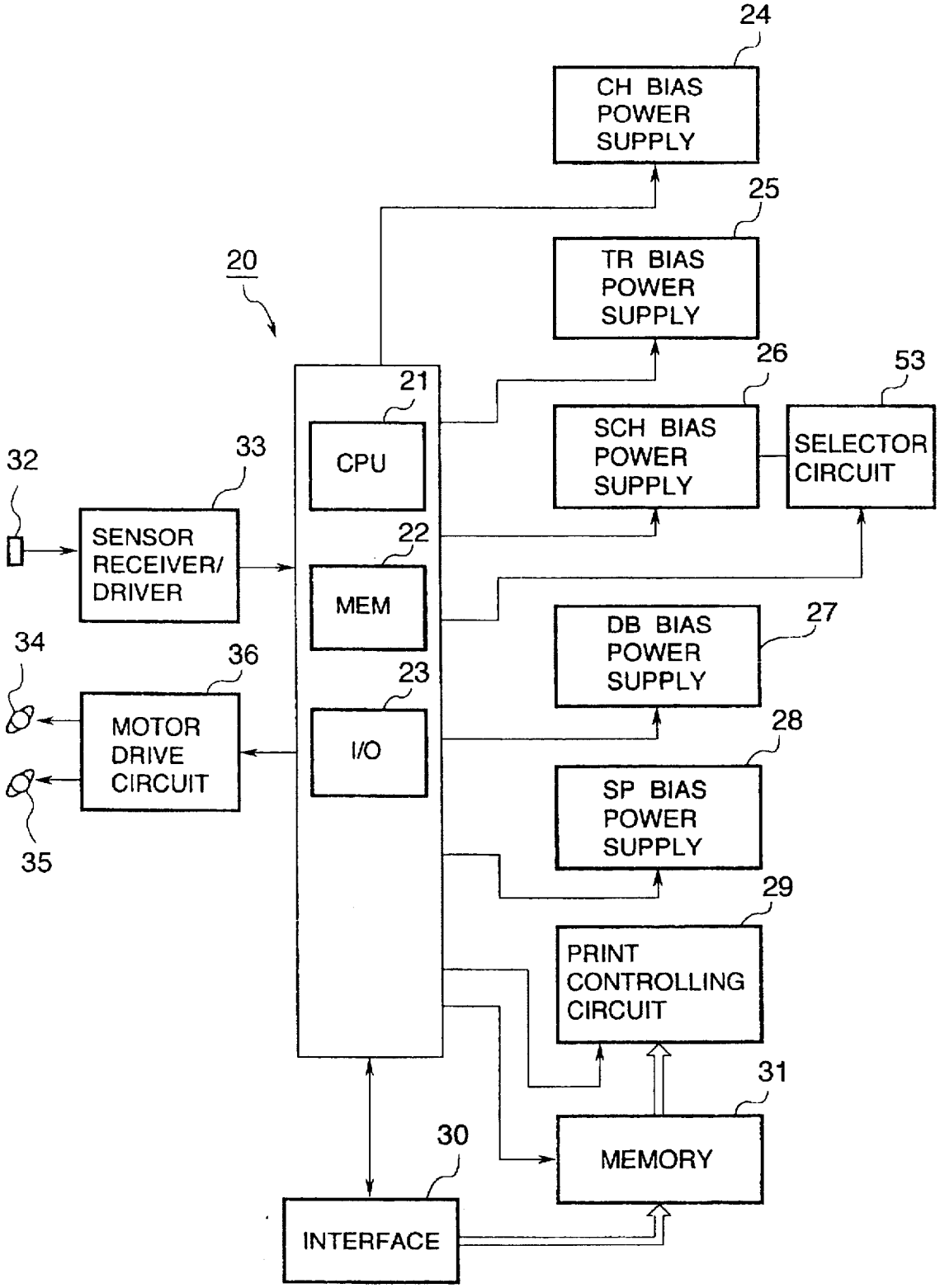
FIG. 10 is a block diagram showing a controlling circuit according to the fourth embodiment.

FIG. 10 is a block diagram showing a controlling circuit according to the fourth embodiment. The controlling circuit of the fourth embodiment is substantially the same as that of the first embodiment except that a selector-controlling switch circuit 53 is added for shifting the selector switch 50.

The CH bias power supply 24, DB bias power supply 27, and TR bias power supply 25 provide a bias voltage of −1300 V to the shaft 2*a* of the charging roller 2, a bias voltage of −300 V to the shaft 8*a* of the developing roller 8, and a bias voltage of +1500 V to the shaft 6*a* of the transfer roller 6, respectively. The first SCH bias power supply 51 provides a bias voltage of +400 V to the shaft 7*a* of the auxiliary charging roller 7 and the second SCH bias power supply 52 provides a bias voltage of −1300 V to the shaft 7*a* of the auxiliary charging roller 7.

FIGS. 11A–11C show the polarities and values of the surface potential of the photosensitive drum and the amount of reversely charged toner particles left on the photosensitive drum, for values of Vch2 in the range from 0 to −3.3 kV with the value of Vch 1 fixed at −2 kV, −1.3 kV, and −1 kV, respectively.

Voltages Vo and Vp show the surface potentials of the photosensitive drum 1 before and after the photosensitive drum is charged by the charging roller 2. Mt represents an amount of reversely charged toner particles that adhere to the charging roller 2. Respective region II enclosed by thick solid lines indicates a region where the toner particles deposited on the photosensitive drum 1 are negatively charged with Mt=0. In the regions II, the bias voltages are such that $|Vch1| \leqq |Vch2|$ and $Vch2 \leqq 0$, and the surface potential Vo is substantially the same as the surface potential Vp. The relation Vo=Vp implies that $|Vch1-Vo| \leqq |Vi|$, Vi being a voltage being applied to the charging roller 2 prior to the charging of the photosensitive drum 1 if the photosensitive drum 1 is to be charged only by the charging roller 2. Thus, the voltage Vi is |Vi|=500 V from the regions II.

Figure 12:
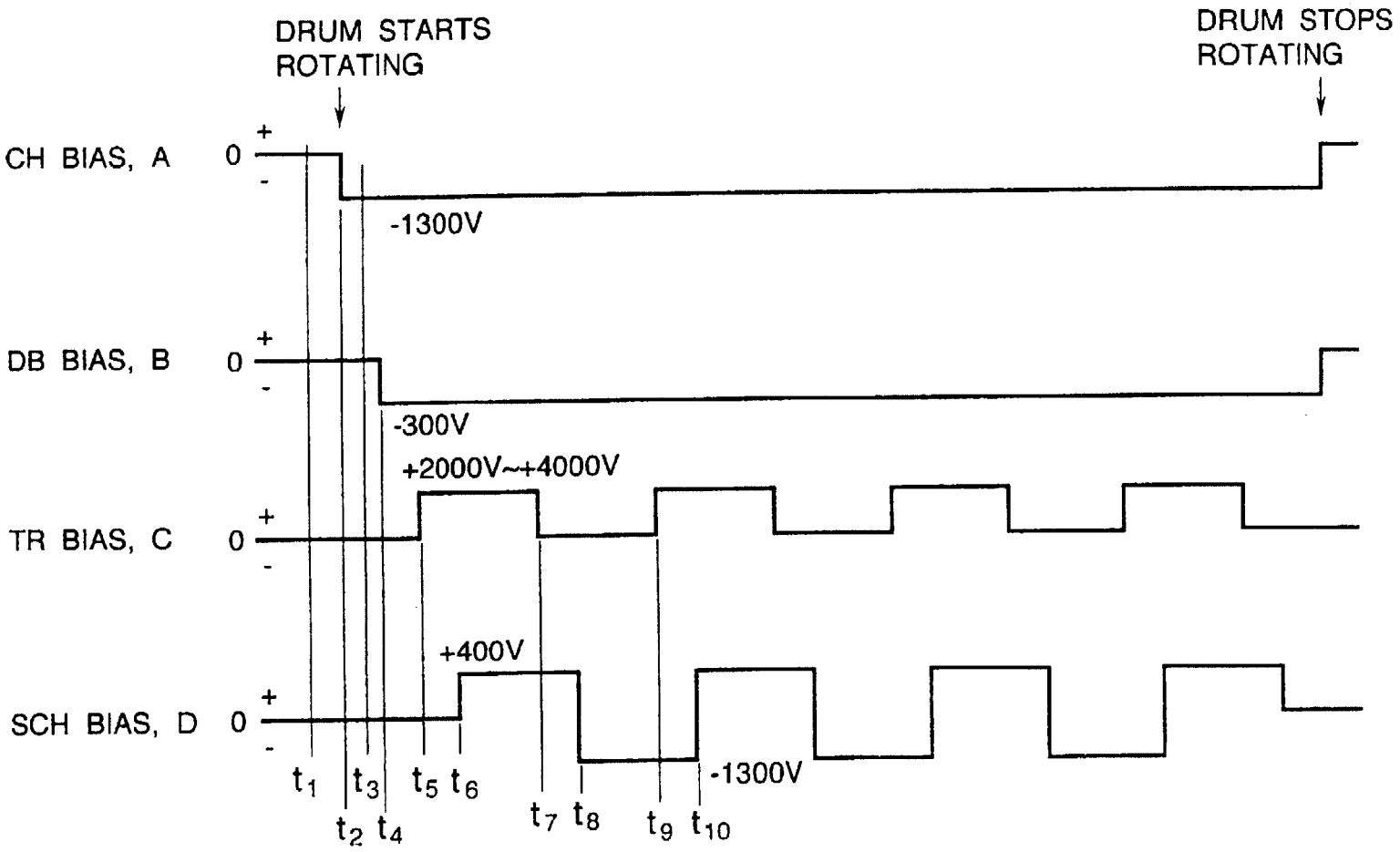
FIG. 12 is a timing chart illustrating the printing operation of the fourth embodiment.

FIG. 12 is a timing chart illustrating the printing operation in the fourth embodiment. Referring to FIG. 12, signals A–D indicate outputs of the CH bias power supply 24, DB bias power supply 27, TR bias power supply 25, and SCH bias power supply 26, respectively.

The operation of the fourth embodiment will now be described with reference to FIG. 12. It is assumed that printing operations is continuous. When a start button, not shown, is pressed at time t1, the CPU 21 sends a drive signal to the motor drive circuit 36. In response to the drive signal, the circuit 36 causes the motor 34 to rotate so as to feed the print paper 5 from the paper cassette to the carrier belt 11 one page at a time. The leading edge of the paper 5 is detected by the paper sensor 32.

When the leading edge of the print paper 5 is detected at time t2, the CPU 21 causes via the motor drive circuit 36 the motor 35 to rotate so that the photosensitive drum 1, charging roller 2, developing roller 8, transfer roller 6, auxiliary roller 7, and carrier belt 11 are rotated. At the same time, the CPU 21 turns on the CH bias power supply 24. The charging roller 2 receives a bias voltage of −1300 V and the surface of the photosensitive drum 1 is uniformly charged to −800 V by the charging roller 2.

At time 3, the CPU 21 causes the memory 31 to output image data to the print controlling circuit 29, and drives via the controlling circuit 29 the light emitting diodes of the recording head 3 to form an electrostatic latent image on the surface of the photosensitive drum 1 charged to −800 V.

At time t4, the CPU 21 turns on the DB bias power supply 27 to apply a bias voltage of −300 V to the developing roller 8. At time t4, a surface area of the photosensitive drum 1 which was in contact with the charging roller 2 at time t2 is now in contact with the developing roller 8. The developing roller 8 causes the toner particles to be negatively charged so as to develop a latent image into a negatively charged developer toner image.

At time t5, the CPU 21 turns on the TR bias power supply 25 to apply a bias voltage of +2000 to +4000 V to the transfer roller 6. At time t5, a surface area of the photosensitive drum 1 which was in contact with the developing roller 8 at time t4 is now in contact with the transfer roller 6. The transfer roller 6 causes the print paper 5 to be positively charged, and causes the negatively charged toner image, arrived at the transfer position, to be transferred to the print paper 5 with the aid of Coulomb force.

At time t6, the CPU 21 turns on the SCH bias power supply 51 to apply a bias voltage of +400 V to the auxiliary charging roller 7. At time t6, a surface area of the photosensitive drum 1 which was in contact with the transfer roller 6 at time t5 is now in contact with the auxiliary roller 7. The auxiliary charging roller 7 attracts the residual developer toner (negatively charged) left on the surface of the photosensitive drum 1 to recover the developer toner into a toner recovering mechanism, not shown. This prevents a residual positive image from occurring in the next printing operation. The charging roller 2 attracts the reversely charged toner particles deposited on the photosensitive drum 1 when the reversely charged toner particles arrive at the charging roller 2.

At time t7, the CPU 21 turns off the TR bias power supply 25. At time t7, the photosensitive drum 1 is in contact with the trailing end of the print paper 5 at a surface area (referred to as Paper Trailing End Contact position, or PTEC position hereinafter) where the photosensitive drum 1 is in contact with the transfer roller 6.

At time t8, the CPU 21 causes the selector switch circuit 53 to switch the selector switch 50 while also turning on the second SCH bias power supply 26 so as to apply a bias voltage of, for example, −1300 V to the auxiliary charging roller 7 such that $|Vch1| \leqq |Vch2|$ and $Vch2 \leqq 0$. At time t8, the PTEC position on the photosensitive drum 1 is in contact with the auxiliary charging roller 7.

At time t9, the CPU 21 turns on the TR bias to apply a bias voltage in the range from +2000 to +4000 V depending on the thickness of print paper 5. At time t9, the next toner image developed from a negatively charged latent image has arrived at the position where the photosensitive drum 1 contacts the leading end of the next print paper 5.

At time t10, the CPU 21 causes the selector controlling circuit 53 to switch the selector switch 50. At the same time, the CPU 21 turns on the first SCH bias power supply 51 so as to apply a bias voltage of +400 V to the auxiliary charging roller 7. At time t10, the photosensitive drum 1 is in contact with the auxiliary charging roller 7, the contact area of the photosensitive drum being a surface area (referred to as Paper Leading End Contact position, or PLEC position hereinafter) where the photosensitive drum 1 was in contact with the transfer roller 6 at time t9.

The aforementioned steps are repeated for multiple copies.

In the fourth embodiment, the auxiliary charging roller 7 also serves as a cleaning roller which recovers the residual developer toner particles on the photosensitive drum during the printing operation. A separate cleaning roller may be provided upstream of the auxiliary charging roller 7, or a blade may be used in place of the cleaning roller. Alternatively, the TR bias power supply may include a first TR bias power supply, a second TR bias power supply, and a selector switch for switching between the first and second TR bias power supplies, and the transfer roller may be used also as an auxiliary charging means.

Figure 9B:
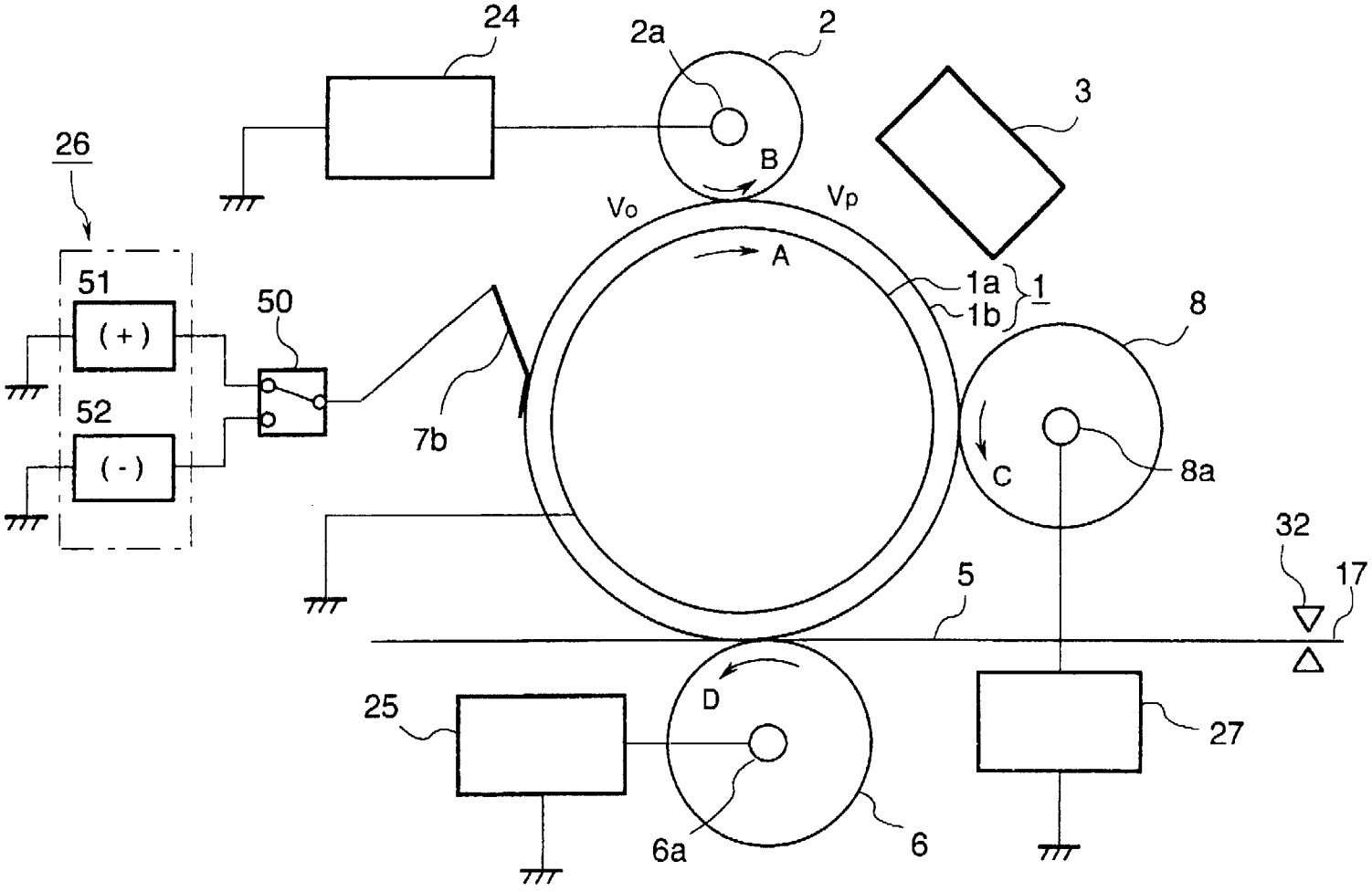
FIG. 9B shows a modification of the fourth embodiment where a cleaning blade is used in place of the auxiliary charging roller.

FIG. 9B shows a modification of the fourth embodiment where a cleaning blade 7*b* is used in place of the auxiliary charging roller 7. The blade rubber is formed of urethane rubber whose electrical resistance is adjusted using conductive carbon. The cleaning blade 7*b* is controlled in the same way as the charging roller 7.

The construction of the fourth embodiment makes it possible to remove both negatively charged toner particles and reversely charged toner particles left on the photosensitive drum, and therefore prevents adverse effects due to a residual positive image and deposition of developer toner on areas other than an electrostatic latent image. Thus, high print quality can be maintained.

Fifth Embodiment

Figure 13:
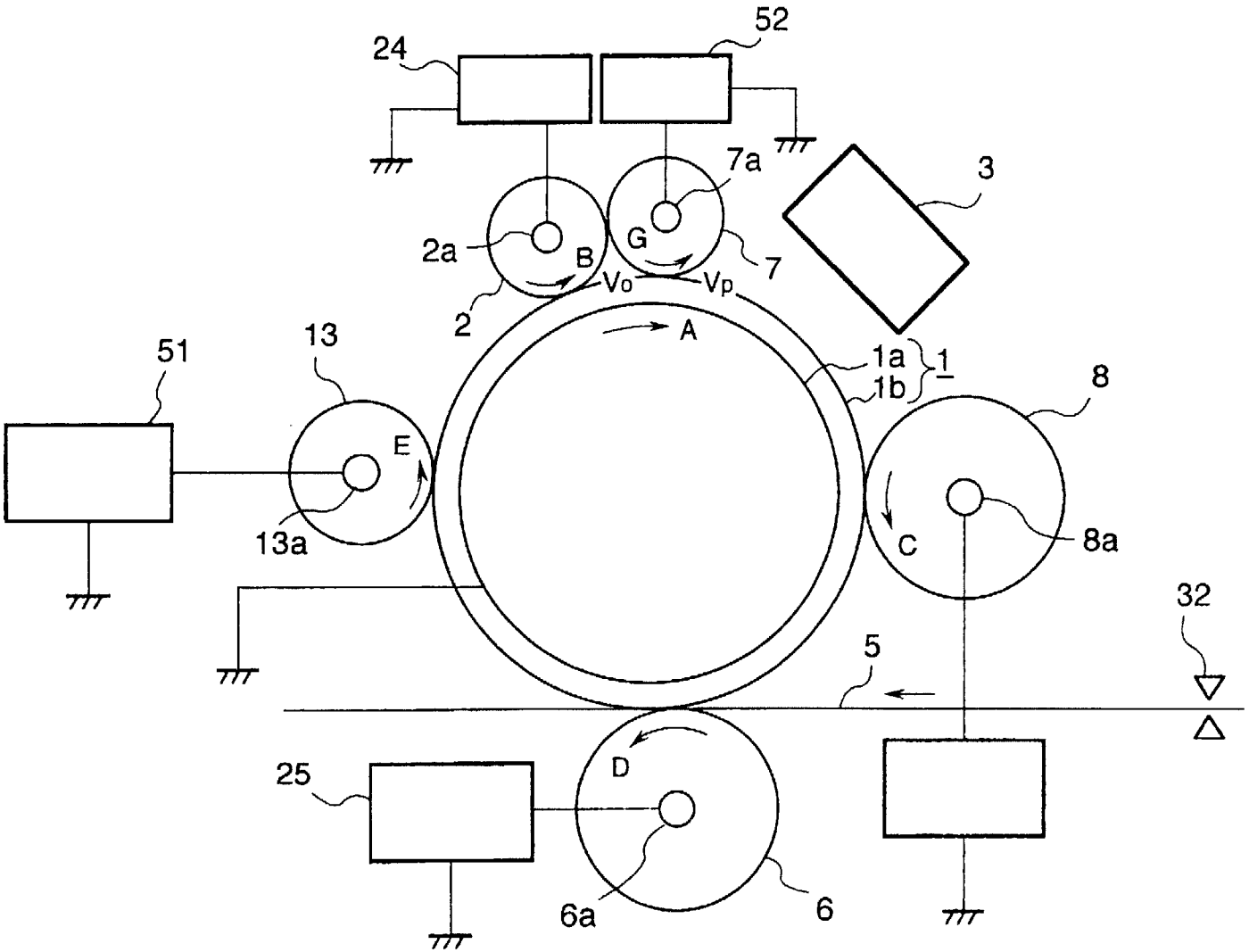
FIG. 13 illustrates a general construction of an image forming apparatus according to a fifth embodiment.

FIG. 13 illustrates a general construction of an image-forming apparatus according to a fifth embodiment. The fifth embodiment is a modification of the fourth embodiment. In the fifth embodiment, the auxiliary charging roller 7 is provided downstream of the charging roller 2, and is in contact with the charging roller 2 and the photosensitive drum 1. The auxiliary charging roller 7 rotates in the same direction as the charging roller 2. The bias voltages Vch1 and Vch2 applied to the rollers 2 and 7, respectively, are such that $|Vch1| \geqq |Vch2|$ and $Vch2<0$, being maintained for a time period from the contact of the trailing edge of the print medium or print paper 5 with the transfer roller 6 till the contact of the leading edge of the next print paper 5 with the transfer roller 6. The voltages Vch1 and Vch2 are of values such that the surface potential of the photosensitive drum 1 is maintained substantially the same before and after the photosensitive drum 1 is charged by the charging roller 2. Thus, the fifth embodiment includes a cleaning roller 13.

The fifth embodiment is characterized by the auxiliary charging roller 7 provided at the aforementioned location. The auxiliary charging roller 7 contacts the charging roller 2 and forcibly peels reversely charged toner particles off the charging roller 2, and causes the polarity of the reversely charged toner to be inverted by triboelectrification.

The polarity of the reversely charged toner particles which have been peeled off the photosensitive drum 1, can be inverted by maintaining the surface potential of the photosensitive drum 1 at substantially the same before and after the photosensitive drum 1 is charged by the auxiliary roller 7, just as in the fourth embodiment. This is accomplished by applying voltages Vch1 an Vch2 to the charging roller 2 and auxiliary roller 7, respectively, such that $|Vch2-Vo| \leqq |Vi|$ and $|Vch2-Vp| \leqq |Vi|$ where Vi is −500 V and Vo and Vp are the surface potential of the photosensitive drum 1 before and after the photosensitive drum 1 is charged by the auxiliary charging roller 7.

Figure 14:
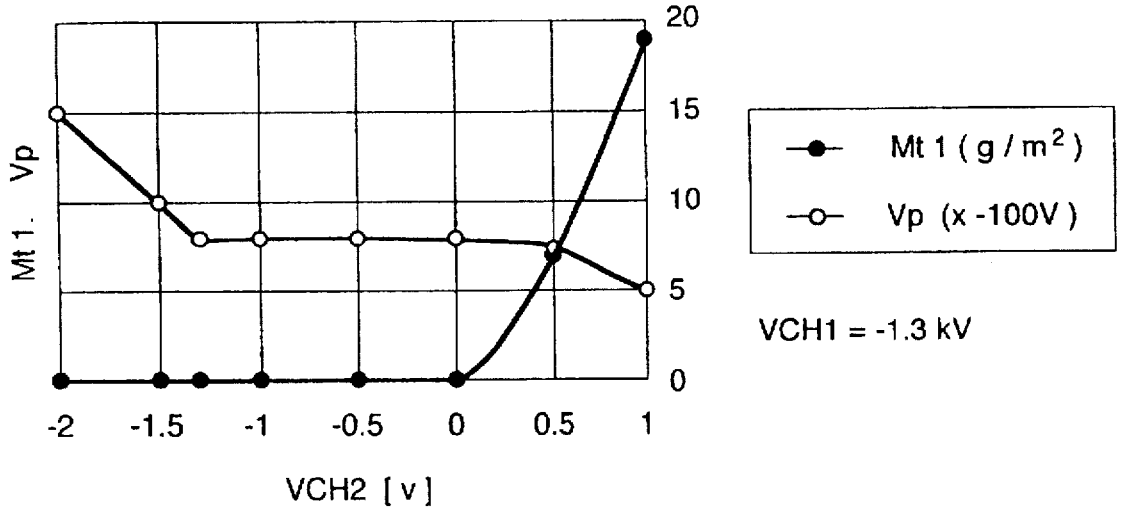
FIG. 14 illustrates the relationship between the surface potential of the photosensitive drum when the drum is charged and the amount of reversely charged toner that is deposited on the charging roller 2.
Figure 15:
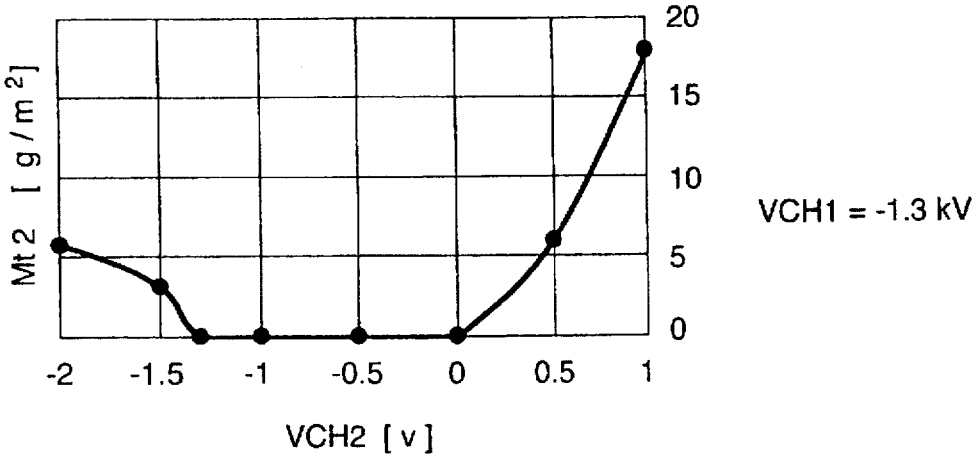
FIG. 15 illustrates the amount of reversely charged toner that is deposited on the auxiliary charging roller when the photosensitive drum.

FIG. 14 illustrates the relationship between the surface potential of the charged photosensitive drum 1 and the amount of reversely charged toner particles that are deposited to the charging roller 2. FIG. 15 illustrates amount of reversely charged toner that is deposited to the auxiliary charging roller when the auxiliary charging roller 7 is charged. FIGS. 14 and 15 show curves for values of Vch2 in the range from +1 to −2 kV with the value of Vch 1 fixed at −1.3 kV. The value of Vo is −800 V since Vch1=−1.3 kV, and the value of Vch2 is in the range of 0 to −1.3 kV since $|Vch2-Vo| \leqq |Vi|$. FIG. 14 shows that amount Mt1 of reversely charged toner is zero, and the surface potential Vp of the photosensitive drum 1 after the auxiliary charging roller 7 is −800 V. FIG. 15 shows that the amount Mt2 of reversely charged toner deposited on the auxiliary charging roller 7 is zero with Vch2 set to values from 0 to −1.3 kV.

The construction of the fifth embodiment makes it possible to remove negatively charged toner particles and reversely charged toner particles left on the photosensitive drum from the photosensitive drum 1, and therefore prevents adverse effects due to a residual positive image and deposition of toner on areas other than the latent image, maintaining high print quality.

Sixth Embodiment

The construction of a sixth embodiment is the same as that of the fourth embodiment. The fourth and sixth embodiments differ in control. The auxiliary charging roller 7 is provided in contact with the photosensitive drum 1, downstream of the transfer roller 6 but upstream of the charging roller 2. The bias voltage Vch2 of the auxiliary charging roller 7 is set to $Vch2<0$ when the photosensitive drum 1 has rotated through an angle so that the PTEC position on the surface of the drum 1 moves into contact engagement with the auxiliary charging roller 7. The application of the bias voltage to the charging roller 2 is terminated when the photosensitive drum 1 further rotates so that the PTEC position moves into contact engagement with the charging roller 2. The auxiliary charging roller 7 is set to zero volts ($Vch2=0$) a predetermined time T3 after the auxiliary charging roller 7 receives the bias voltage $Vch2<0$, the predetermined time T3 being a time required for the charging roller 2 to rotate through its one complete rotation.

Figure 16:
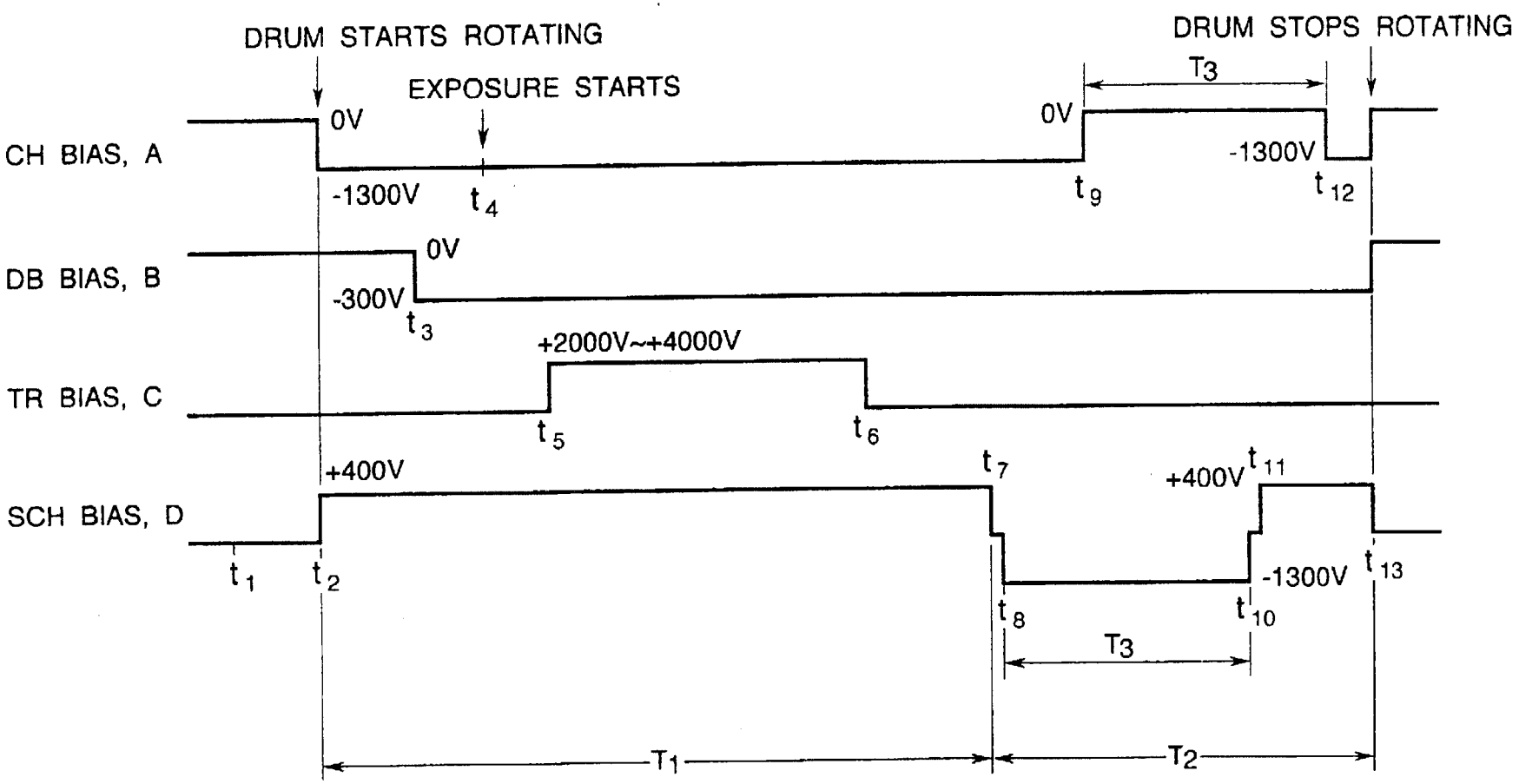
FIG. 16 is a timing chart for illustrating the image-forming operation in the sixth embodiment.

FIG. 16 is a timing chart for illustrating the image-forming operation in the sixth embodiment. Referring to FIG. 16, signals A–D indicate outputs of the CH bias power supply 24, DB bias power supply 27, TR bias power supply 25, and SCH bias power supply 26, respectively. The time duration T1 from t2–t7 is "printing operation" of one page of print medium or print paper 5 and the time duration T2 from t7–t13 is "toner recovering operation."

The operation of the sixth embodiment will now be described with reference to FIG. 16. When a start button, not shown, is pressed at time t1, the CPU 21 sends a drive signal to the motor drive circuit 36. In response to the drive signal from the CPU 21, the motor drive circuit 36 causes the motor 34 to rotate so that a page of print paper 5 is fed to the carrier belt 11 from the paper cassette. The leading edge of the print paper 5 is detected by the paper sensor 32.

Upon detecting the leading edge of the print paper 5 at time t2, the CPU 21 causes via the motor drive circuit 36 the motor 35 to rotate so that the photosensitive drum 1, charging roller 2, developing roller 8, transfer roller 6, auxiliary roller 7, and carrier belt 11 are rotated. At the same time, the CPU 21 turns on the CH bias power supply 24 and the first SCH bias power supply 51. The charging roller 2 receives a bias voltage of −1300 V and the auxiliary charging roller 7 receives a bias voltage of +400 V. The surface of the photosensitive drum 1 is uniformly charged to −800 V by the charging roller 2.

At time t3, the CPU 21 turns on the DB bias power supply 27 to apply a bias voltage of −300 V to the developing roller 8 so as to negatively charge the toner. At time t3, a surface area of the photosensitive drum 1 which was in contact with the charging roller 2 at time t2 is now in contact with the developing roller 8.

At time t4, the CPU 21 causes the memory 24 to output image data to the print controlling circuit 29, and drives via the print controlling circuit 29 the light emitting diodes of the recording head 3 to form an electrostatic latent image on the surface of the photosensitive drum 1. The electrostatic latent image is supplied with negatively charged toner particles upon arriving at the developing roller 8, being converted into a toner image.

At time t5, the CPU 21 turns on the TR bias power supply 25 to apply a bias voltage in the range from +2000 to +4000 V to the transfer roller 6, depending on the thickness of print paper 5. The transfer roller 6 causes the print paper 5 to be positively charged, and the negatively charged toner image, arrived at the transfer position, is transferred to the print paper with the aid of Coulomb force. The negatively charged toner particles (residual developer toner or residual toner image) left on the surface of the photosensitive drum 1 after transfer, migrate along the electric field to the auxiliary charging roller 7 with the aid of Coulomb force, and is recovered in the toner recovering mechanism, not shown. When the surface of the photosensitive drum 1 rotates to the charging roller 2, the reversely charged toner particles deposited on the photosensitive drum 1, migrate to the charging roller 2 along the electric field between the photosensitive drum 1 and charging roller 2 with the aid of Coulomb force.

At time t6, the CPU 21 turns off the TR bias power supply 25. At time t6, the PTEC position of the photosensitive drum 1 is in contact with the auxiliary charging roller 7.

At time t7, the CPU 21 turns off the first SCH bias power supply 51. The PTEC position of the photosensitive drum 1 is now in contact with the auxiliary charging roller 7. At time t8, the CPU 21 causes the selector controlling circuit 53 to switch the selector switch 50 while also turning on the second SCH bias power supply 52. The auxiliary charging roller 7 receives a bias voltage of, for example, −1300 V so that Vch2<0 is satisfied. Printing operation is performed during time duration T1, from time t2 to time t7.

At time t9, the CPU 21 turns off the CH bias power supply 24. At time t9, the PTEC position of the photosensitive drum 1 is in contact the charging roller 2. The surface of the photosensitive drum 1 following the PTEC position is uniformly charged to −800 V by the auxiliary charging roller 7. Therefore, the reversely charged toner particles deposited on the charging roller 2 migrate along the electric field to the photosensitive drum 1 with the aid of Coulomb force.

At time t10, the CPU 21 turns off the second SCH bias power supply 52 so that Vch2=0. The time duration from t8 to t10 is a predetermined time length T3 equal to a time length required for the charging roller 2 to rotate through one complete rotation.

At time t11, the CPU 21 causes the selector controlling circuit 53 to switch the selector switch 50 while also turning on the first SCH bias power supply 51. The auxiliary charging roller 7 now receives a bias voltage of +400 V.

At time t12, the CPU 21 turns on the CH bias power supply 24 to apply a bias voltage of −1300 V to the charging roller 2. The CH bias power supply remains turned on for a time duration T3, from time t9 to time t12, the time duration T3 being a time duration required for the charging roller 2 to rotate one complete rotation. At time t12, a surface area of the photosensitive drum 1 which was in contact with the auxiliary charging roller 7 at time t11 is now in contact with the charging roller 2.

At time t13, the CPU 21 turns off the CH bias power supply 24, DB bias power supply 27, and first SCH bias power supply 51, and causes the photosensitive drum 1, charging roller 2, developing roller 8, transfer roller 6, auxiliary roller 7 to stop rotating, completing one cycle of printing operation. The toner recovering operation (t7–t13) in FIG. 16 is performed once every, for example, 20 pages are copied. Some amount of the reversely charged toner particles migrated from the charging roller 2 to the photosensitive drum 1 is recovered by the developing roller 8 into the toner developer 4 and the rest is again deposited on the charging roller 2.

Figure 17:
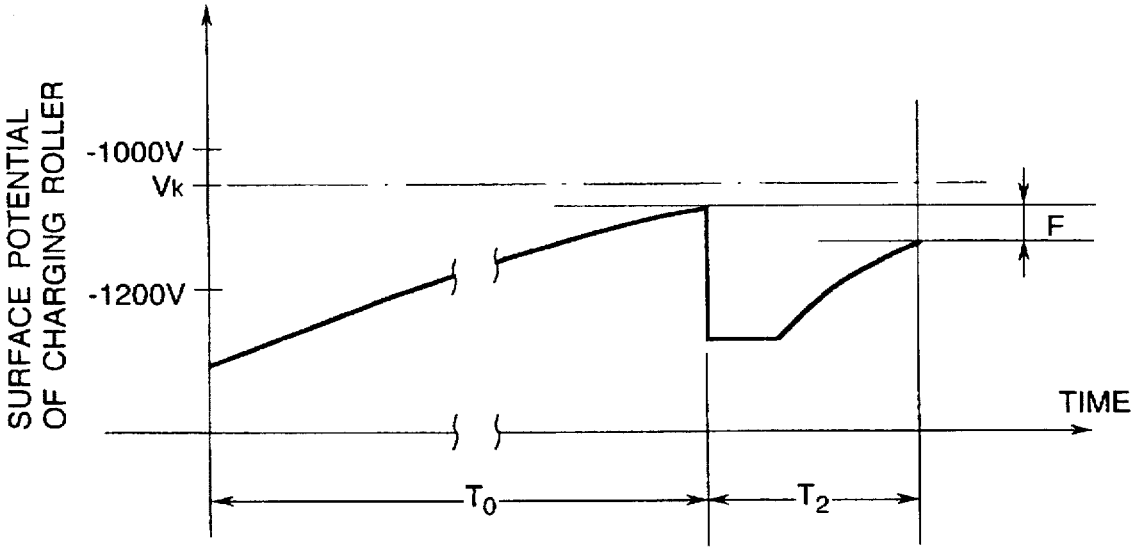
FIG. 17 shows changes in surface potential of the charging roller 2 during printing operation.

Changes in surface potential of the charging roller 2 during printing operation will now be described with respect to FIG. 17. Referring to FIG. 17, the surface potentials of the charging roller 2 above a critical potential Vk, result in adverse effects such as deposition of toner on unilluminated area of the photosensitive drum 1. The surface potential is substantially the same as the applied voltage until the reversely charged toner is deposited to the surface. The surface potential increases as the reversely charged toner particles build up on the surface. If toner recovering operation is carried out when the surface potential has reached near the critical potential Vk a time To after deposition of reversely charged toner, then the surface potential temporarily decreases to 80–90% of its initial value but again increases due to the fact that the reversely charged toner left unremoved by the developing roller 8 is again deposited on the charging roller 2. The net decrease in surface potential is F.

Performing the recovering operation of reversely charged toner particles after every printing cycle, increases the total time required for printing a plurality of pages. Thus, for example, toner recovering operation is performed once every 20 pages have been copied.

The construction of the sixth embodiment makes it possible to remove negatively charged toner particles and reversely charged toner particles left on the photosensitive drum, and therefore prevents adverse effects due to a residual positive image and deposition of toner on areas other than the electrostatic latent image, maintaining high print quality.

Seventh Embodiment

The sixth and seventh embodiments are the same in construction but differ in the operation of recovering of the reversely charged toner. In the sixth embodiment, some amount of the reversely charged toner particles that have returned to the photosensitive drum 1 fail to be recovered in the toner developer 4. It is known that some amount of the reversely charged toner particles is converted into negatively charged toner particles and returns to the photosensitive drum 1 if the charging roller 2 continues to rotate with the reversely charged toner deposited thereon. Experiments revealed that the smaller the resistance of the roller, the more rapidly the toner inverted to negative charges returns to the photosensitive drum 1, provided that the same negative voltages are applied to the charging roller 2, transfer roller 6, and auxiliary charging roller 7, respectively. If the auxiliary charging roller 7 has a resistance smaller than that of the charging roller 2, adverse effects may be eliminated more efficiently by allowing the reversely charged toner particles which have failed to be recovered in the toner developer 4, to be first deposited on the auxiliary charging roller 7 and then converted into negatively charged toner particles before returning to the photosensitive drum 1. This is more efficient than simply returning the reversely charged toner that has failed to be recovered into the toner developer 4, to the charging roller 2.

Figure 18:
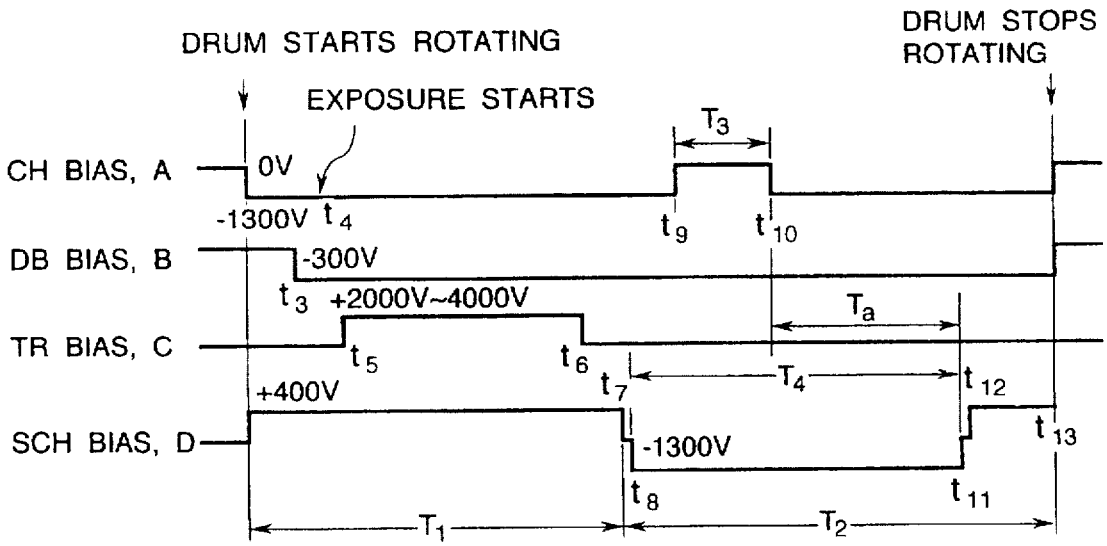
FIG. 18 is a timing chart illustrating the printing operation of the seventh embodiment.
Figure 19:
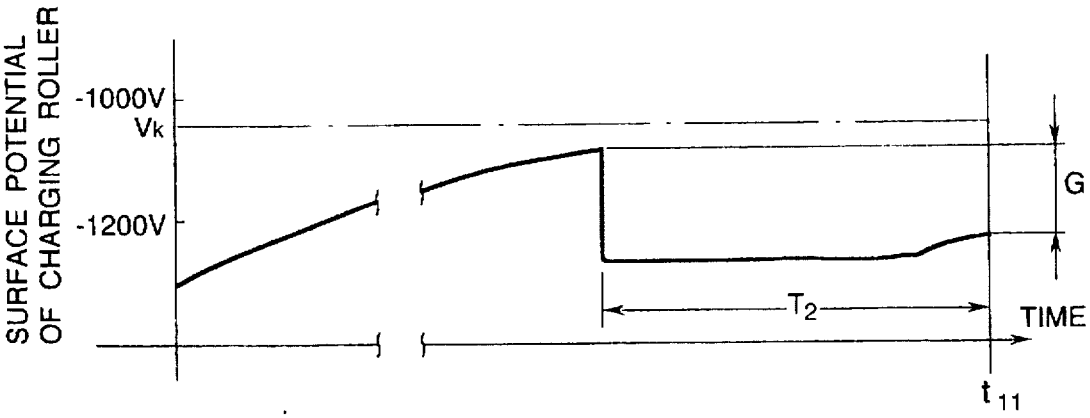
FIG. 19 illustrates changes in the surface potential of the charging roller of the seventh embodiment.

FIG. 18 is a timing chart illustrating the printing operation of the seventh embodiment. Printing operation is performed during time duration T1 and toner recovery operation is performed during time duration T2. FIG. 17 illustrates changes in the surface potential of the charging roller of the seventh embodiment. The timing chart of the seventh embodiment differs from that (FIG. 16) of the sixth embodiment in operation after time t9, i.e., the auxiliary charging roller 7 is charged to a negative voltage for a longer time. A surface area of the photosensitive drum 1 in contact with the charging roller 2 when the CH bias power supply 24 is turned on at time t10, moves into contact engagement with the auxiliary charging roller 7 at time t12. An amount of the reversely charged toner particles which have migrated from the charging roller 2 to the photosensitive drum 1 during T3, is recovered by the developing roller 8 into the toner developer 4 while the rest remains deposited on the photosensitive drum 1 and is delivered to the auxiliary charging roller 7 on which the reversely charged toner particles are deposited. Then, the auxiliary charging roller 7 is further rotated for the time period Ta during which the reversely charged toner particles on the auxiliary charging roller 7 are converted into negatively charged toner particles, subsequently being returned to the photosensitive drum 1 charged to −800 v. As shown in FIG. 19, the surface potential of the charging roller 2 after toner recovering operation is restored by the quantity G, which indicates more improvement than that shown in FIG. 17. The aforementioned operation for recovering reversely charged toner particles, allows the polarity of the reversely charged toner particles to be inverted for reuse of toner, and improves restoration of the surface potential of the charging roller after toner-recovering operation. This maintains high print quality.

Eighth Embodiment

The construction of an eighth embodiment is substantially the same as that of the sixth embodiment except that the construction includes memory means 60 for storing the number of pages which can be printed continuously before the next reversely charged toner recovering operation is performed, counting means 61 for counting the number of printed pages every time printing operation is performed, and timing-determining means 62 for comparing the number of pages read out of the memory means 60 with the content of the counting means 61 to cause the reversely-charged-toner recovering means to perform reversely charged toner recovering operation.

Figure 20:
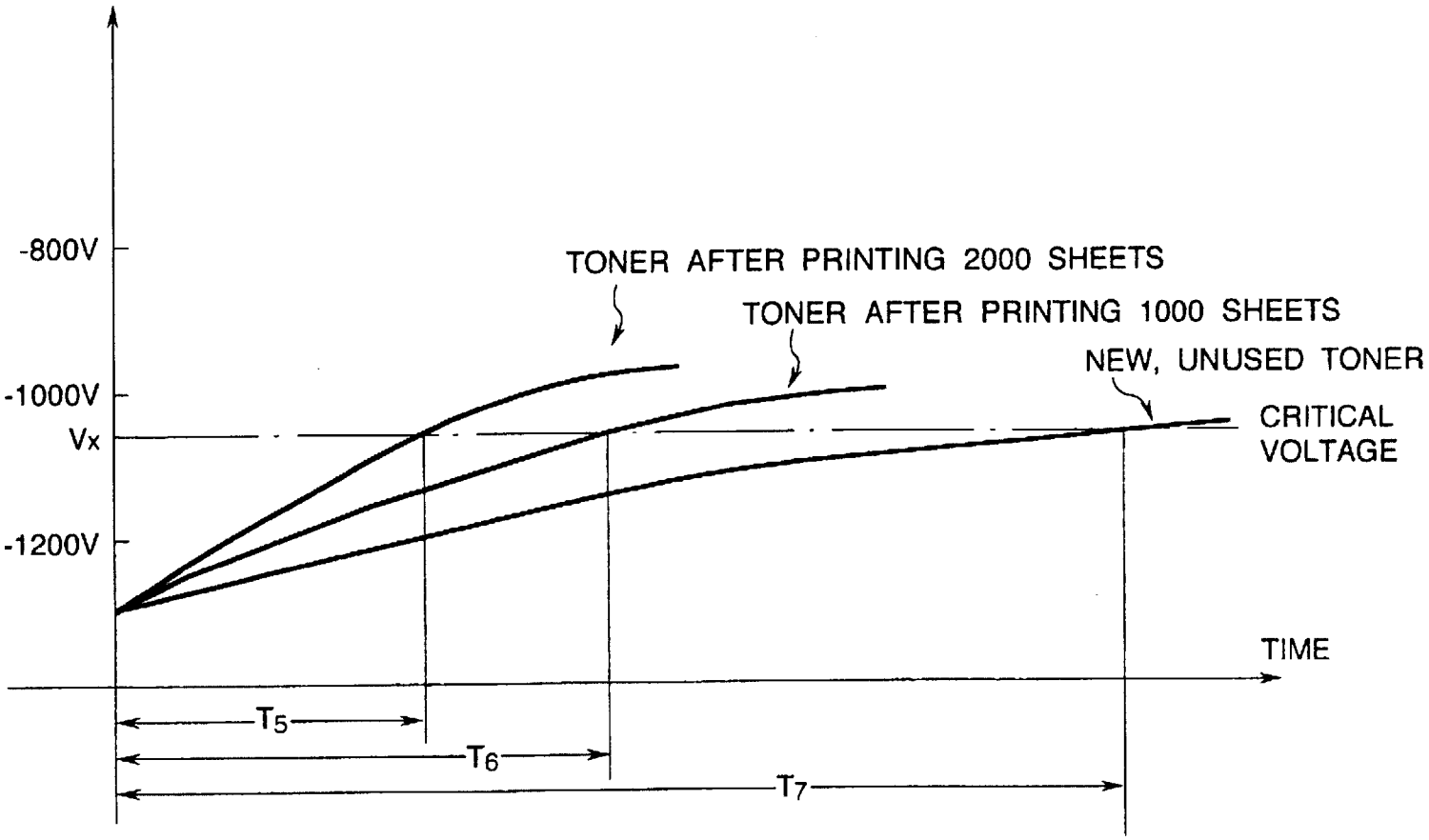
FIG. 20 shows comparison of the critical potential Vk for different levels of deterioration of toner.

The sixth embodiment performs reversely-charged-toner recovering operation every time a predetermined number of pages have been printed. It is to be noted that fresh toner differs from re-used toner in the time required for the surface voltage of the charging roller to reach the critical potential Vk above which print quality is adversely affected. FIG. 20 shows comparison of time length before the critical potential Vk is reached for unused toner, toner after printing 1000 pages, and toner after printing 2000 pages, each toner being used in separate image-forming apparatuses. Toner is deteriorated with increasing number of printed pages and therefore the time required to reach the critical potential Vk is shorter.

In the eighth embodiment, the intervals of reversely-charged-toner recovering operation is varied in accordance with the degree of deterioration of toner.

Figures 21, 22:
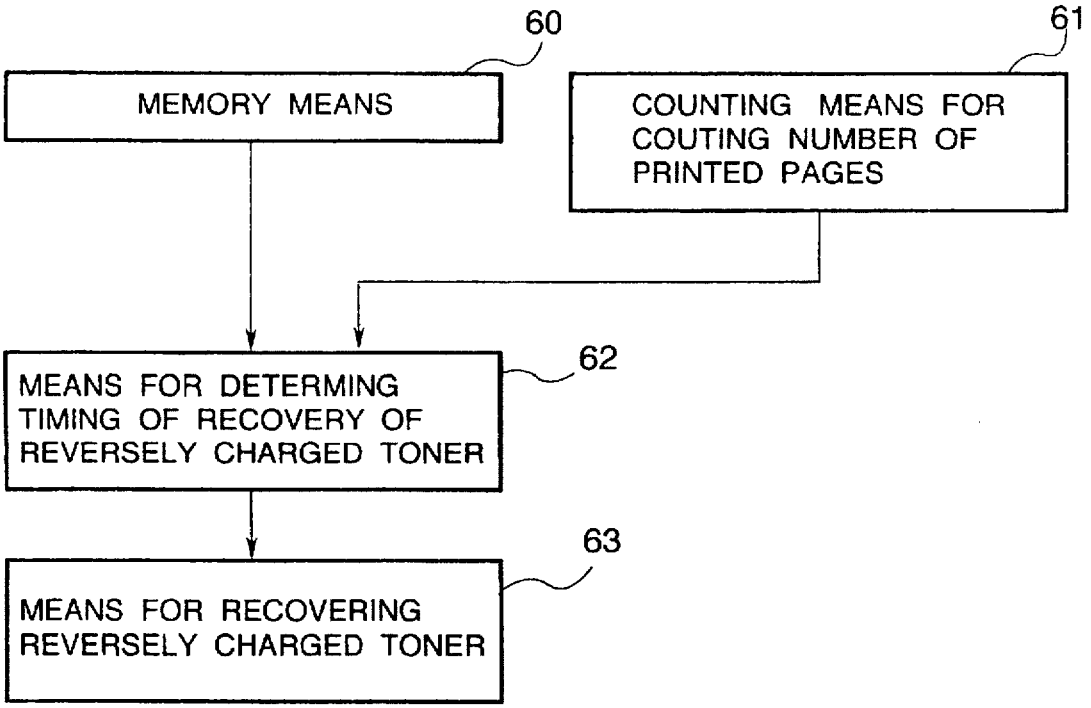
FIG. 21 is a block diagram showing an image forming apparatus according to an eighth embodiment.
FIG. 22 illustrates a table stored in the MEM in which the number of printed pages is shown.

FIG. 21 is a block diagram showing an image-forming apparatus according to the eighth embodiment. The memory means 60 stores the number of pages which can be printed continuously before the next reversely-charged-toner recovering operation. The counting means 61 counts the number of printed pages every time printing operation is performed. The determining means 62 compares the number of pages read out of the memory 60 with the content of the counting means 61 to cause the reversely-charged-toner recovering means to determine whether reversely charged toner recovering operation should be performed. In practice, the MEM 22 in FIG. 10 operates as the memory means 60, and the CPU 21 operates as the counting means 61 to count the number of pulses of a phase-switching signal of a motor 34 and stores the counted number of pulses into the MEM 22. The CPU 21 also reads the number of pages that can be printed before the next reversely-charged-recovering operation and the counted number of pulses from the MEM 22 and compares them. If the number of pages matches the counted number of pulses, then the CPU causes the reversely charged toner recovering means described in the sixth embodiment to operate.

Figures 23, 24:
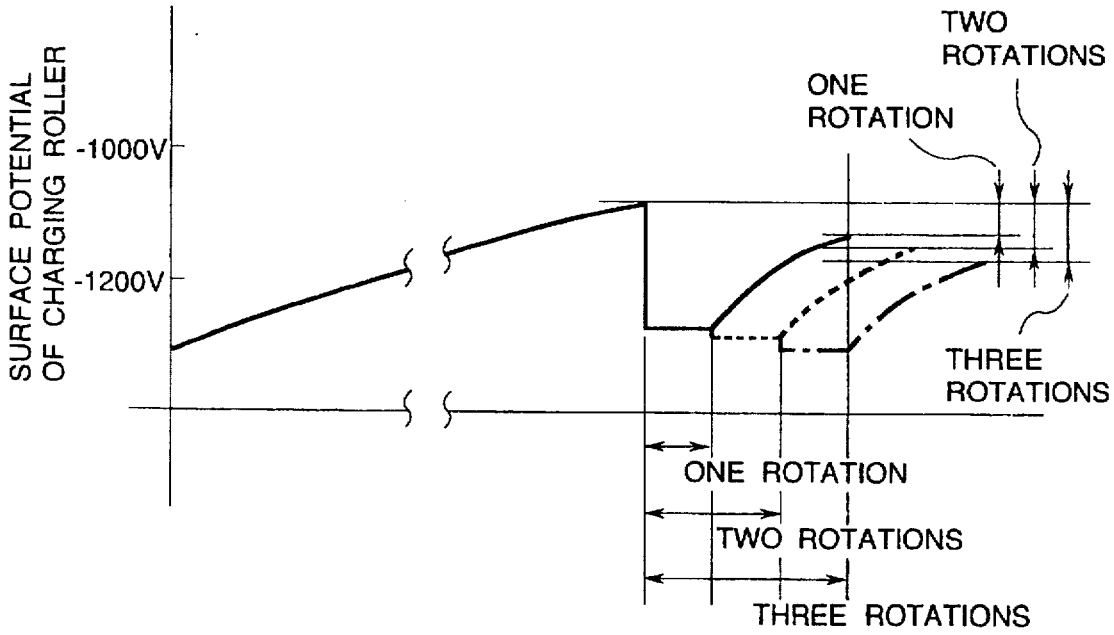
FIG. 23 illustrates the relationship between the number of printed pages and the time duration for which the charging roller receives the bias voltage.
FIG. 24 shows changes in the surface potential of the charging roller for different time periods for which the charging roller receives a voltage.

FIG. 22 illustrates a table stored in the MEM 22, in which the number of pages for respective range is shown. For example, range 1 represents the number of printed pages from zero up to A1 when fresh, unused toner is used. Assuming that A1 is, for example, 1000, the number N1 of pages that can be printed before the next reversely-charged-toner recovering operation, is given by N1=T5/T0 where T5 is the time required for the surface potential to reach critical potential Vk and T0 is the time required for printing one page. Likewise, assuming that A2 is, for example, 2000, the number N2 of pages that can be printed before the next reversely-charged-toner recovering operation, is given by N2=T4/T0 where T4 is the time required for the surface potential to reach critical potential Vk and T0 is the time required for printing one page. Numbers N3–Nn for other ranges are calculated similarly. In practice, the ranges may be further subdivided so that each subdivided range has a smaller number of pages. Deterioration of toner with increasing cumulative number of printed pages, results in shorter time required for the surface potential to reach the critical potential Vk after the reversely-charged-toner recovering operation. Thus, the reversely-charged-toner recovering operation is performed by the aforementioned means until the cumulative number of printed pages reaches a predetermined value. Larger the cumulative number of printed pages over the predetermined value, longer time the charging roller 2 is maintained to zero volts. For example, as shown in FIG. 23, for the range where the number of printed pages is from zero to 3000, the time for which the charging roller 2 is maintained to zero volts and the time for which the auxiliary charging roller 7 receives −1300 V from the second SCH bias power supply 52 are set to time period $T_3$ which is the time required for the charging roller 2 to rotate through one complete rotation as in the sixth embodiment. The aforementioned time periods are set to $2T_3$ for the number of printed pages from 3001 to 4000, and to $3T_3$ for the number of printed pages from 4001 to 5000.

FIG. 24 shows changes in the surface potential of the charging roller 2 for different time periods for which the charging roller 2 receives a voltage. FIG. 24 shows that restoration in surface potential of the charging roller 2 is improved with increased time for which the charging roller 2 receives a voltage or the more rotations of the charging roller 2. While the eighth embodiment has been described in comparison with the sixth embodiment, the eighth embodiment may be applicable to any of the aforementioned respective embodiments.

In the eighth embodiment, the reversely-charged-toner recovering operation is performed taking into account deterioration of toner due to the cumulative number of printing operations. Performing the reversely-charged-toner recovering operation in this manner is more effective than the seventh embodiment, and maintains high print quality.

What is claimed is:

1. A method of forming an electrostatic latent image comprising the steps of:

causing a first charging roller to uniformly negatively charge a surface of a rotating photosensitive drum the first charging roller rotating in contact with the photosensitive drum;

forming an electrostatic latent image on the surface of the photosensitive drum;

supplying negatively charged developer toner from a developer to the electrostatic latent image formed on the photosensitive drum to convert the electrostatic latent image into a toner-developed image;

transferring the toner-developed image onto a print medium by means of a transfer roller;

causing a second charging roller to uniformly negatively charge the surface of the photosensitive drum after transferring the toner-developed image, the second charging roller being located upstream of the first charging roller with respect to rotation of the photosensitive drum the photosensitive drum being charged by the second charging roller in such a manner that a potential of the surface of the photosensitive drum is substantially the same before and after the photosensitive drum is subsequently charged by the first charging roller so that the reversely charged toner deposited on the first charging roller is inverted to negatively charged toner without a discharge between the first charging roller and the photosensitive drum, and the negatively inverted toner migrates from the first charging roller to the photosensitive drum and is subsequently recovered by the developer.

2. The method according to claim 1, further including the step of:

applying, during toner recovery operation, a voltage Vch1 to the first charging roller when causing the first charging roller to charge the photosensitive drum, and a voltage Vch2 to the second charging roller when causing the second charging roller to charge the photosensitive drum, the voltages being related such that $|Vch1| \leqq |Vch2|$ and $Vch2 \leqq 0$, the voltages Vch1 and Vch2 being of values such that a surface potential of said photosensitive drum is substantially the same before and after said photosensitive drum is charged by the first charging roller.

3. The method according to claim 2, wherein said first charging roller and said second charging roller receive the voltages Vch1 and Vch2, respectively, from when said second charging roller moves into contact with a surface point of said photosensitive drum which was in contact with a trailing end of a print medium till a surface point of said photosensitive drum moves into contact with a leading end of a following print medium.

4. The method according to claim 1, wherein said step of charging the photosensitive drum includes the steps of:

providing an auxiliary charging roller in contact with said photosensitive drum and said charging roller, said auxiliary charging roller being downstream of said transfer roller and upstream of said charging roller;

rotating said auxiliary charging roller in the same direction as said charging roller; and applying voltages Vch1 and Vch2 to said auxiliary charging roller, respectively, such that $|Vch1| \geqq |Vch2|$ and $Vch2 \leqq 0$, the voltages Vch1 and Vch2 being of values such that a surface potential of said photosensitive drum is substantially the same before and after said photosensitive drum is charged by said auxiliary charging roller.

5. The method according to claim 1, wherein said step of charging the photosensitive drum further includes the steps of:

storing the number of pages which can be printed continuously before reversely charged toner recovering operation is performed;

counting the number of printed pages every time printing operation is performed; and comparing the number of pages read out of said memory with the content of said counter to cause the reversely charged toner recovering device to perform reversely charged toner recovering operation.

6. A method of forming an electrostatic latent image comprising the steps of:

causing a first charging roller to uniformly negatively charge a surface of a rotating photosensitive drum;

forming an electrostatic latent image on the surface of the photosensitive drum;

supplying negatively charged developer toner from a developer to the electrostatic latent image formed on the photosensitive drum to convert a toner-developed image;

transferring the toner-developed image onto a print medium by means of a transfer roller;

applying a voltage $Vch2<0$ to a second charging roller for a predetermined time period during toner recovering operation after transferring the toner-developed image so that the second charging roller charging the photosensitive drum at a predetermined voltage $Vch2<0$, the second charging roller being downstream of the transfer roller and upstream of the first charging roller, whereby reversely charged toner deposited on the first charging roller migrates from the first charging roller to said photosensitive drum, the reversely charged toner having a polarity opposite to the negatively charged developer toner; and recovering the reversely charged toner migrated to said photosensitive drum into a developer.

7. The method according to claim 6, wherein said step of charging the photosensitive drum further includes the steps of:

storing the number of pages which can be printed continuously before reversely charged toner recovering operation is performed;

counting the number of printed pages every time printing operation is performed; and comparing the number of pages read out of said memory with the content of said counter to cause the reversely charged toner recovering device to perform reversely charged toner recovering operation.

8. The method according to claim 6, wherein the predetermined time is a time period required for the first charging roller to rotate through its one complete rotation.

9. The method according to claim 6, wherein said predetermined time is longer than a time period from when a first surface position on said photosensitive drum moves into contact with said first charging roller till said first surface position moves into contact with the second charging roller.

10. An image-forming apparatus comprising:

a rotating photosensitive drum having a surface on which an electrostatic latent image is formed;

a first charging roller for uniformly negatively charging the surface of said photosensitive drum prior to formation of the electrostatic latent image the first charging roller rotating in contact with the photosensitive drum;

a developer for supplying developer toner to the electrostatic latent image on the surface of said photosensitive drum to form a toner-developed image;

a transfer roller for transferring the toner-developed image onto a print medium;

a second charging roller for uniformly negatively charging the surface of said photosensitive drum after having transferred the toner-developed image, said second charging roller being downstream of said transfer roller and upstream of said first charging roller; and a reversely-charged toner recovering controller for recovering reversely charged toner which has a polarity opposite to the developer toner, said controller causing said second charging roller to charge the surface of said photosensitive drum after said transfer roller has transferred the toner-developed image to the print medium, the surface of said photosensitive drum being charge by said second charging roller in such a manner that a potential of the surface of said photosensitive drum is substantially the same before and after said photosensitive drum is subsequently charged by said first charging roller, whereby the reversely charged toner deposited on said first charging roller is inverted to negatively charged toner without a discharge occurring between said first charging roller and said photosensitive drum, and the negatively inverted toner migrates from said first charging roller to said photosensitive drum and is subsequently recovered by said developer.

11. The image-forming apparatus according to claim 10, wherein said charging roller and said second charging roller receiving voltages Vch1 and Vch2, respectively, such that $|Vch1| \leqq |Vch2|$ and $Vch2 \leqq 0$, the voltages Vch1 and Vch2 being of values such that a surface potential of said photosensitive drum is substantially the same before and after said photosensitive drum is charged by said first charging roller, said first charging roller and said second charging roller receiving the voltages Vch1 and Vch2 during toner recovering operation.

12. The image-forming apparatus according to claim 11, wherein said first charging roller and said second charging roller receive the voltages Vch1 and Vch2, respectively, from when said second charging roller moves into contact with a surface point of said photosensitive drum which was in contact with a trailing end of a print medium till a surface point of said photosensitive drum moves into contact with a leading end of a following print medium.

13. The image-forming apparatus according to claim 10, wherein said auxiliary charging device is an auxiliary charging roller in contact with said photosensitive roller and said charging roller, said auxiliary charging roller being downstream of said transfer roller and upstream of said charging roller and rotating in the same direction as said charging roller, said auxiliary charging roller receiving voltages Vch1 and Vch2, respectively, such that $|Vch1| \geqq |Vch2|$ and $Vch2<0$, the voltages Vch1 and Vch2 being of values such that a surface potential of said photosensitive drum is substantially the same before and after said photosensitive drum is charged by said auxiliary charging roller, said charging roller and said auxiliary charging roller receiving the voltages Vch1 and Vch2 during toner recovering operation.

14. The image-forming apparatus according to claim 10 further includes:

memory for storing the number of pages which can be printed continuously before reversely charged toner recovering operation is performed;

counter for counting the number of printed pages every time printing operation is performed; and timing-determining device for comparing the number of pages read out of said memory with the content of said counter to cause the reversely charged toner recovering device to perform reversely charged toner recovering operation.

15. An image-forming apparatus comprising:

a rotating photosensitive drum on which an electrostatic latent image is formed;

a first charging roller for uniformly negatively charging said photosensitive drum prior to formation of the electrostatic latent image;

a developer for supplying developer toner to the electrostatic latent image on the photosensitive drum to form a toner-developed image;

a transfer roller for transferring the toner-developed image onto a print medium;

a second charging roller for uniformly negatively charging said photosensitive drum after having transferred the toner-developed image said second charging roller being downstream of said transfer roller and upstream of said first charging roller;

a reversely-charged-toner recovering controller for recovering reversely charged toner which has a polarity opposite to the developer toner, said controller causing said second charging roller to receive a voltage $Vch2<0$ for a predetermined time period during toner recovering operation so that the reversely charged toner migrates from said first charging roller to said photosensitive drum, the toner migrated to said photosensitive drum being subsequently recovered by said developer.

16. The image-forming apparatus according to claim 15 further includes:

memory for storing the number of pages which can be printed continuously before reversely charged toner recovering operation is performed;

counter for counting the number of printed pages every time printing operation is performed; and timing-determining device for comparing the number of pages read out of said memory with the content of said counter to cause the reversely charged toner recovering device to perform reversely charged toner recovering operation.

17. The image-forming apparatus according to claim 15, wherein the predetermined time is a time period required for the first charging roller to rotate through its complete rotation.

18. The image-forming apparatus according to claim 15, wherein said predetermined time being a time period from when a first surface position on said photosensitive drum moves into contact with said second charging roller till said first surface position of the photosensitive drum moves again into contact with the second charging roller.

19. A method of forming an electrostatic latent image comprising the steps of:

causing a charging roller to uniformly negatively charge a surface of a rotating photosensitive drum;

forming an electrostatic latent image on the surface of the photosensitive drum;

supplying negatively charged developer toner from a developer to the electrostatic latent image formed on the photosensitive drum to convert the electrostatic latent image into a toner-developed image;

transferring the toner-developed image onto a print medium by means of a transfer roller;

causing a cleaning blade to uniformly negatively charge the surface of the photosensitive drum after transferring the toner-developed image, the cleaning blade being located upstream of the charging roller with respect to rotation of the photosensitive drum, the photosensitive drum being charged by the cleaning blade in such a manner that a potential of the surface of the photosensitive drum is substantially the same before and after the photosensitive drum is subsequently charged by the charging roller so that the reversely charged toner deposited on the charging roller is inverted to negatively charged toner without a discharge between the charging roller and the photosensitive drum, and the negatively inverted toner migrates from the charging roller to the photosensitive drum and is subsequently recovered by the developer.

20. The method according to claim 19, further including the step of:

applying, during toner recovery operation, a voltage Vch1 to the charging roller when causing the charging roller to charge the photosensitive drum, and a voltage Vch2 to the cleaning blade when causing the cleaning blade to charge the photosensitive drum, the voltages being related such that $|Vch1| \leqq |Vch2|$ and $Vch2 \leqq 0$, the voltages Vch1 and Vch2 being of values such that a surface potential of said photosensitive drum is substantially the same before and after said photosensitive drum is charged by the charging roller.

21. The method according to claim 20, wherein said charging roller and said cleaning blade receive the voltages Vch1 and Vch2, respectively, from when said cleaning blade moves into contact with a surface point of said photosensitive drum which was in contact with a trailing end of a print medium till a surface point of said photosensitive drum moves into contact with a leading end of a following print medium.

22. An image-forming apparatus comprising:

a rotating photosensitive drum having a surface on which an electrostatic latent image is formed;

a charging roller for uniformly negatively charging the surface of said photosensitive drum prior to formation of the electrostatic latent image;

a developer for supplying developer toner to the electrostatic latent image on the surface of said photosensitive drum to form a toner-developed image;

a transfer roller for transferring the toner-developed image onto a print medium;

a cleaning blade for uniformly negatively charging the surface of said photosensitive drum after having transferred the toner-developed image, said cleaning blade being downstream of said transfer roller and upstream of said charging roller; and a reversely-charged toner recovering controller for recovering reversely charged toner which has a polarity opposite to the developer toner, said controller causing said cleaning blade to charge the surface of said photosensitive drum after said transfer roller has transferred the toner-developed image to the print medium, the surface of said photosensitive drum being charge by said cleaning blade in such a manner that a potential of the surface of said photosensitive drum is substantially the same before and after said photosensitive drum is subsequently charged by said charging roller, whereby the reversely charged toner deposited on said charging roller is inverted to negatively charged toner without a discharge occurring between said charging roller and said photosensitive drum, and the negatively inverted toner migrates from said charging roller to said photosensitive drum and is subsequently recovered by said developer.

23. The image-forming apparatus according to claim 22, wherein said charging roller and said cleaning blade receiving voltages Vch1 and Vch2, respectively, such that $|Vch1| \leqq |Vch2|$ and $Vch2 \leqq 0$, the voltages Vch1 and Vch2 being of values such tat a surface potential of said photosensitive drum is substantially the same before and after said photosensitive drum is charged by said charging roller, said charging roller and said cleaning blade receiving the voltages Vch1 and Vch2 during toner recovering operation.

24. The image-forming apparatus according to claim 23, wherein said charging roller and said cleaning blade receive the voltages Vch1 and Vch2, respectively, from when said cleaning blade moves into contact with a surface point of said photosensitive drum which was in contact with a trailing end of a print medium till a surface point of said photosensitive drum moves into contact with a leading end of a following print medium.

* * * * *